US010222737B2

(12) United States Patent
Kitamura et al.

(10) Patent No.: US 10,222,737 B2
(45) Date of Patent: Mar. 5, 2019

(54) IMAGE FORMING APPARATUS CAPABLE OF MOVING BELT UNIT TOGETHER WITH SUPPORT MEMBER

(71) Applicant: Brother Kogyo Kabushiki Kaisha, Nagoya-shi, Aichi-ken (JP)

(72) Inventors: Yukiko Kitamura, Nagoya (JP); Takashi Arakawa, Nagoya (JP); Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/718,310

(22) Filed: Sep. 28, 2017

(65) Prior Publication Data

US 2018/0246464 A1 Aug. 30, 2018

(30) Foreign Application Priority Data

Feb. 28, 2017 (JP) ..... 2017-037293

(51) Int. Cl.
*G03G 15/00* (2006.01)
*G03G 21/16* (2006.01)
*G03G 21/18* (2006.01)

(52) U.S. Cl.
CPC ..... *G03G 21/1638* (2013.01); *G03G 21/1671* (2013.01); *G03G 21/1853* (2013.01); *G03G 2221/1684* (2013.01)

(58) Field of Classification Search
USPC ..... 399/107, 110, 116, 117, 297–299, 302, 399/303, 308
See application file for complete search history.

(56) References Cited

U.S. PATENT DOCUMENTS

| | | | | |
|---|---|---|---|---|
| 6,708,011 | B2 * | 3/2004 | Nomura | G03G 15/0896 399/110 |
| 8,705,989 | B2 | 4/2014 | Kawamura et al. | |
| 9,134,692 | B2 * | 9/2015 | Sato | G03G 15/0896 |
| 2010/0239271 | A1 | 9/2010 | Kawamura et al. | |
| 2012/0027459 | A1 | 2/2012 | Sato | |
| 2014/0056628 | A1 | 2/2014 | Sato | |
| 2014/0363213 | A1 | 12/2014 | Sato | |
| 2016/0011559 | A1 | 1/2016 | Sato | |

FOREIGN PATENT DOCUMENTS

| | | |
|---|---|---|
| JP | 2010-217810 A | 9/2010 |
| JP | 2012-032610 A | 2/2012 |

* cited by examiner

*Primary Examiner* — Hoan Tran
(74) *Attorney, Agent, or Firm* — Banner & Witcoff, Ltd.

(57) ABSTRACT

An image forming apparatus includes: a main body casing; a photosensitive drum; a support member; a belt unit; a transfer roller; and a second sheet guide. The support member is movable between a first accommodated position and a first withdrawn position. The belt unit is movable between a second accommodated position and a second withdrawn position. The belt unit includes: a first sheet guide; and a transfer belt. The belt unit is movable together with the support member. The second sheet guide is positioned below the belt unit and faces the first sheet guide to define a sheet conveying path between the first sheet guide and the second sheet guide in a state where the belt unit is at the second accommodated position. The second sheet guide is configured to convey a sheet along the sheet conveying path toward a position between the transfer belt and the transfer roller.

20 Claims, 12 Drawing Sheets

IMAGE FORMING APPARATUS CAPABLE OF MOVING BELT UNIT TOGETHER WITH SUPPORT MEMBER

CROSS REFERENCE TO RELATED APPLICATION

This application claims priority from Japanese Patent Application No. 2017-037293 filed Feb. 28, 2017. The entire content of the priority application is incorporated herein by reference.

TECHNICAL FIELD

The present disclosure relates to an image forming apparatus.

BACKGROUND

There is conventionally known an intermediate transfer type image forming apparatus including: a support member supporting a photosensitive drum; a belt unit having a transfer belt; and a sheet conveying path extending below the belt unit. The support member is movable between an accommodated position at which the support member is accommodated in a main body casing and a withdrawn position at which the support member is withdrawn from the main body casing. When the support member is at the accommodated position, the support member is positioned above the belt unit so as to contact the transfer belt.

SUMMARY

However, in the image forming apparatus described above, in a case where a sheet of paper is jammed in the sheet conveying path, a user have to perform the following troublesome operations: removing the support member from the main body casing; and removing the belt unit from the main body casing; and then opening the sheet conveying path to remove the sheet jammed in the sheet conveying path.

In view of the foregoing, it is an object of the disclosure to provide an image forming apparatus in which a sheet conveying path can be opened smoothly for removal of a jammed paper sheet.

In order to attain the above and other objects, according to one aspect, the disclosure provides an image forming apparatus including: a main body casing; a photosensitive drum; a support member; a belt unit; a transfer roller; and a second sheet guide. The main body casing has an opening. The support member is configured to support the photosensitive drum. The support member is movable through the opening between a first accommodated position and a first withdrawn position. At the first accommodated position, the support member is accommodated in the main body casing. At the first withdrawn position, the support member is withdrawn from the main body casing. The belt unit is movable through the opening between a second accommodated position and a second withdrawn position. At the second accommodated position, the belt unit is accommodated in the main body casing. At the second withdrawn position, the belt unit is withdrawn from the main body casing. The belt unit includes: a first sheet guide; and a transfer belt. The transfer belt is configured to be in contact with the photosensitive drum in a state where the support member supporting the photosensitive drum is at the first accommodated position and where the belt unit is at the second accommodated position. The belt unit is positioned below the photosensitive drum in a state where the support member supporting the photosensitive drum is at the first accommodated position and where the belt unit is at the second accommodated position. The belt unit is movable from the second accommodated position to the second withdrawn position together with the support member in a case where the support member moves from the first accommodated position to the first withdrawn position. The transfer roller is configured to be in contact with an outer surface of the transfer belt in a state where the belt unit is at the second accommodated position. The second sheet guide is positioned below the belt unit and faces the first sheet guide to define a sheet conveying path between the first sheet guide and the second sheet guide in a state where the belt unit is at the second accommodated position. The second sheet guide is configured to convey a sheet along the sheet conveying path toward a position between the transfer belt and the transfer roller.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
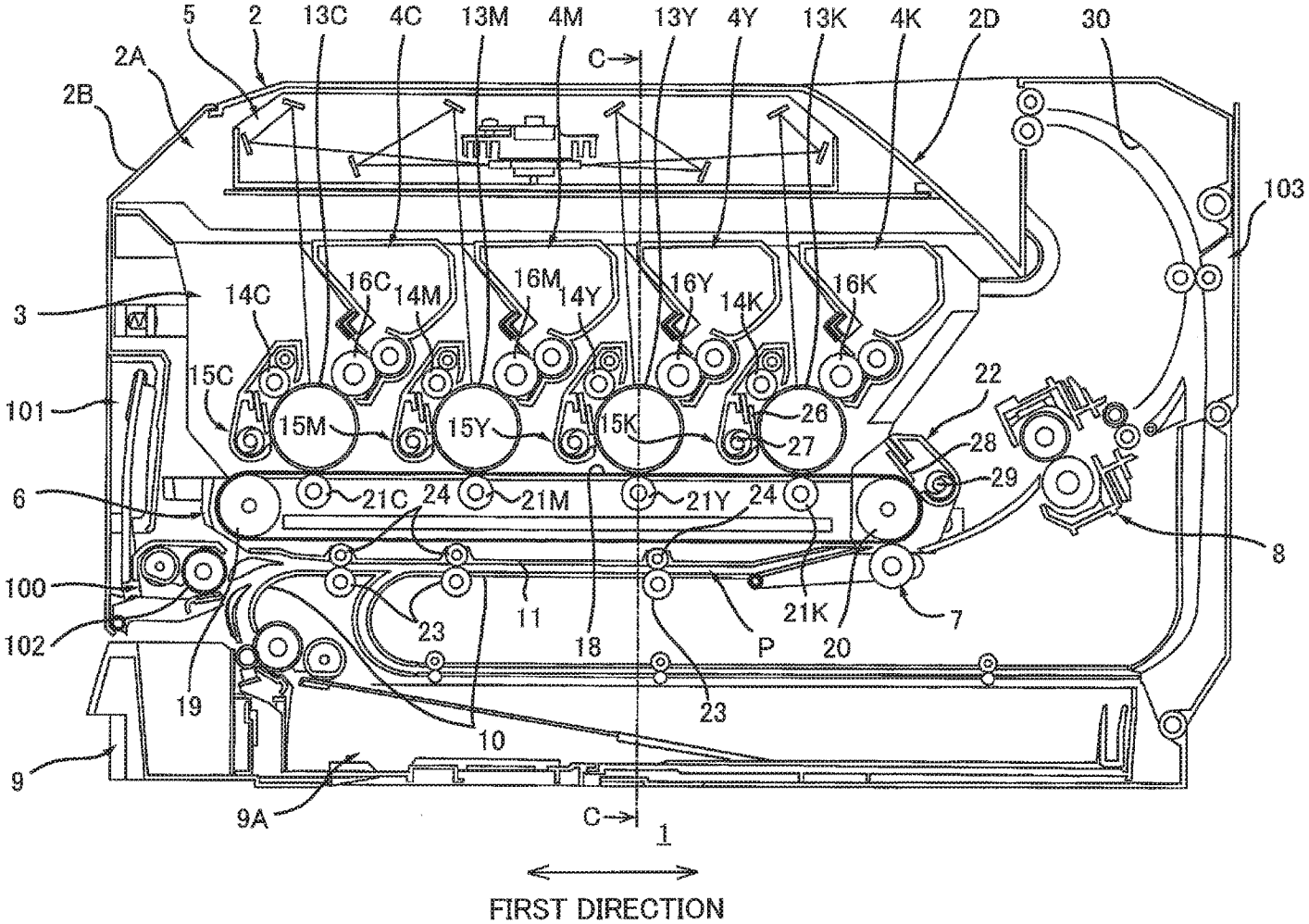
FIG. 1 is a schematic cross-sectional view of an image forming apparatus according to one embodiment.

An image forming apparatus 1 according to one embodiment will be described with reference to the accompanying drawings, wherein like parts and components are designated by the same reference numerals to avoid duplicating description.

1. Overall Structure of Image Forming Apparatus

With reference to FIG. 1, an overall structure of the image forming apparatus 1 will be described.

The image forming apparatus 1 is an intermediate transfer type color printer. The image forming apparatus 1 includes a main body casing 2, a drum unit 3 as an example of a support member, a plurality of developing cartridges 4K, 4Y, 4M, and 4C, a laser scanning unit 5, a belt unit 6, a transfer roller 7, a fixing device 8, a sheet supply tray 9, a second sheet guide 10, and a waste toner box 25 (see FIG. 7).

1.1 Main Casing

The main body casing 2 constitutes an outer cover of the image forming apparatus 1. The main body casing 2 has an opening 2A. Further, the main body casing 2 has a front cover 2B. The opening 2A allows the drum unit 3 and the belt unit 6 to pass therethrough. The front cover 2B is pivotally movable between an open position (see FIG. 9) at which the opening 2A is opened and a closed position (see FIG. 1) at which the opening 2A is closed.

1.2 Drum Unit

The drum unit 3 is movable, through the opening 2A, between an accommodated position (see FIG. 1) at which the drum unit 3 is accommodated in the main body casing 2 and a withdrawn position (see FIG. 9) at which the drum unit 3 is withdrawn from the main body casing 2. The accommodated position of the drum unit 3 at this time will also be referred to as a first accommodated position. Further, the withdrawn position of the drum unit 3 at this time will also be referred to as a first withdrawn position. The drum unit 3 is movable between the first accommodated position and the first withdrawn position in a first direction. At the first withdrawn position, the drum unit 3 is at least partly withdrawn to an outside of the main body casing 2.

The drum unit 3 includes a plurality of photosensitive drums 13K, 13Y, 13M, and 13C, a plurality of charging rollers 14K, 14Y, 14M, and 14C, and a plurality of drum cleaners 15K, 15Y, 15M, and 15C.

The photosensitive drums 13K, 13Y, 13M, and 13C are arranged juxtaposed with one another and spaced apart from one another in the first direction. The photosensitive drum 13K will also be referred to as a first photosensitive drum 13K. Further, the photosensitive drum 13Y will also be referred to as a second photosensitive drum 13Y. The drum unit 3 further includes a first side frame 31 and a second side frame 32. The first side frame 31 and the second side frame 32 will be described later in detail. The first side frame 31 and the second side frame 32 rotatably support the photosensitive drums 13K, 13Y, 13M, and 13C. That is, the drum unit 3 supports at least the first photosensitive drum 13K, and the second photosensitive drum 13Y arrayed with the first photosensitive drum 13K in the first direction.

Note that the photosensitive drums 13K, 13Y, 13M, and 13C have the same structure as one another, the charging rollers 14K, 14Y, 14M, and 14C have the same structure as one another, and the drum cleaners 15K, 15Y, 15M, and 15C have the same structure as one another. Thus, the following description will be given with reference to the photosensitive drum 13K, the charging roller 14K, and the drum cleaner 15K. Description of the photosensitive drums 13Y, 13M, and 13C, the charging rollers 14Y, 14M, and 14C, and the drum cleaners 15Y, 15M, and 15C will be omitted.

The photosensitive drum 13K is rotatable about a rotation axis that extends in an axial direction. The axial direction crosses the first direction. Preferably, the axial direction is orthogonal to the first direction. The photosensitive drum 13K extends in the axial direction. The photosensitive drum 13K has a cylindrical shape.

The charging roller 14K is configured to charge a peripheral surface of the photosensitive drum 13K. The charging roller 14K is in contact with the peripheral surface of the photosensitive drum 13K.

The drum cleaner 15K has a cleaning blade 26 and an auger screw 27.

The cleaning blade 26 is configured to remove toner from the photosensitive drum 13K. The cleaning blade 26 is in contact with the peripheral surface of the photosensitive drum 13K. The toner removed from the photosensitive drum 13K by the cleaning blade 26 is accumulated inside the drum cleaner 15K.

The auger screw 27 is configured to convey the toner removed from the photosensitive drum 13K by the cleaning blade 26 toward a toner conveying tube 50 (see FIG. 3A, described later). The auger screw 27 is positioned inside the drum cleaner 15K. The auger screw 27 extends in the axial direction.

1.3 Developing Cartridge

The developing cartridges 4K, 4Y, 4M, and 4C have the same structure as one another. Thus, the following description will be given with reference to the developing cartridge 4K, and description of the developing cartridges 4Y, 4M, and 4C will be omitted.

The developing cartridge 4K is detachably attached to the drum unit 3. The developing cartridge 4K is configured to supply toner to the peripheral surface of the photosensitive drum 13K. Specifically, the developing cartridge 4K can accommodate toner therein. The developing cartridge 4K includes a developing roller 16K. The developing roller 16K is configured to supply the toner accommodated in the developing cartridge 4K to the peripheral surface of the photosensitive drum 13K. In a case where the developing cartridge 4K is attached to the drum unit 3, the developing roller 16K contacts the peripheral surface of the photosensitive drum 13K.

1.4 Laser Scanning Unit

The laser scanning unit 5 is configured to expose the photosensitive drums 13K, 13Y, 13M, and 13C to light. Taking the photosensitive drum 13K as an example, the laser scanning unit 5 exposes the peripheral surface of the photosensitive drum 13K to light after the peripheral surface of the photosensitive drum 13K is charged by the charging roller 14K. As a result, an electrostatic latent image is formed on the peripheral surface of the photosensitive drum 13K. Thereafter, toner is supplied to the electrostatic latent image by the developing cartridge 4K, whereby a toner image is formed on the peripheral surface of the photosensitive drum 13K.

1.5 Belt Unit

The belt unit 6 is configured to transfer the toner image on the peripheral surface of each of the photosensitive drums 13K, 13Y, 13M, and 13C onto a transfer belt 18 (described later). The belt unit 6 is movable between an accommodated position (see FIG. 1) at which the belt unit 6 is accommodated in the main body casing 2 through the opening 2A and a withdrawn position (see FIG. 10) at which the belt unit 6 is withdrawn from the main body casing 2. The accommodated position of the belt unit 6 at this time will also be referred to as a second accommodated position. Further, the withdrawn position of the belt unit 6 at this time will also be referred to as a second withdrawn position. At the second withdrawn position, the belt unit 6 is at least partly withdrawn to an outside of the main body casing 2.

In a state where the drum unit 3 is at the first accommodated position and where the belt unit 6 is at the second accommodated position, the belt unit 6 is positioned below the photosensitive drums 13K, 13Y, 13M, and 13C.

The belt unit 6 includes a drive roller 19, a driven roller 20, the transfer belt 18, a plurality of primary transfer rollers 21K, 21Y, 21M, and 21C, a belt cleaner 22, and a first sheet guide 11.

The drive roller 19 is configured to drive the transfer belt 18. Specifically, the drive roller 19 is configured to circularly move the transfer belt 18. The drive roller 19 is rotatable about a rotation axis that extends in the axial direction.

The driven roller 20 is configured to drive the transfer belt 18 in cooperation with the drive roller 19. Specifically, the driven roller 20 is configured to circularly move the transfer belt 18 in cooperation with the drive roller 19. The driven roller 20 is positioned spaced apart from the drive roller 19 in the first direction. The driven roller 20 is rotatable about a rotation axis that extends in the axial direction. The driven roller 20 rotates in conjunction with the transfer belt 18 as the drive roller 19 circularly moves the transfer belt 18.

The transfer belt 18 is in contact with the photosensitive drums 13K, 13Y, 13M, and 13C in a state where the drum unit 3 is at the first accommodated position and where the belt unit 6 is at the second accommodated position. The transfer belt 18 is an endless belt. The transfer belt 18 is stretched around the drive roller 19 and the driven roller 20. Specifically, the transfer belt 18 extends in the first direction in a state of being stretched around the drive roller 19 and the driven roller 20. The transfer belt 18 circularly moves around the drive roller 19 and the driven roller 20.

The primary transfer rollers 21K, 21Y, 21M, and 21C are positioned between the drive roller 19 and the driven roller 20 in the first direction. The primary transfer rollers 21K, 21Y, 21M, and 21C are arranged spaced apart from one another in the first direction. The primary transfer rollers 21K, 21Y, 21M, and 21C have the same structure as one another. Thus, the following description will be given with reference to the primary transfer roller 21K, and description of the primary transfer rollers 21Y, 21M, and 21C will be omitted. The primary transfer roller 21K is configured to transfer the toner image formed on the surface of the photosensitive drum 13K onto the transfer belt 18. The transfer belt 18 is interposed between the primary transfer roller 21K and the photosensitive drum 13K in a state where the drum unit 3 is at the first accommodated position and where the belt unit 6 is at the second accommodated position.

The belt cleaner 22 includes a belt cleaning blade 28 and an auger screw 29.

The belt cleaning blade 28 is configured to remove toner from the transfer belt 18. The belt cleaning blade 28 is in contact with the transfer belt 18. The toner removed from the transfer belt 18 by the belt cleaning blade 28 is accumulated inside the belt cleaner 22.

The auger screw 29 is configured to convey the toner removed by the belt cleaning blade 28 toward the waste toner box 25. Specifically, the auger screw 29 is configured to convey the toner removed from the transfer belt 18 by the belt cleaning blade 28 toward a belt toner conveying tube 64 (see FIG. 6, described later). The auger screw 29 is positioned inside the belt cleaner 22. The auger screw 29 extends in the axial direction.

The first sheet guide 11 is positioned between the transfer belt 18 and the second sheet guide 10 in a vertical direction. Although the first sheet guide 11 will be described later in detail, the first sheet guide 11 is positioned at a lower end portion of the belt unit 6. The first sheet guide 11 is movable together with the transfer belt 18 during the movement of the belt unit 6 between the second accommodated position and the second withdrawn position. The first sheet guide 11 is positioned above the second sheet guide 10 and faces the second sheet guide 10 in a state where the belt unit 6 is at the second accommodated position. The first sheet guide 11 defines a sheet conveying path P in cooperation with the second sheet guide 10 in a state where the belt unit 6 is at the second accommodated position. The first sheet guide 11 includes a plurality of sheet conveying rollers 24. The sheet conveying rollers 24 are an example of a first sheet conveying roller.

The sheet conveying rollers 24 are arranged spaced apart from one another in the first direction. The sheet conveying rollers 24 are configured to convey a sheet of paper along the sheet conveying path P toward a position between the transfer belt 18 and the transfer roller 7 in cooperation with a plurality of sheet conveying rollers 23 (described later). That is, the first sheet guide 11 is configured to convey a sheet along the sheet conveying path P toward the position between the transfer belt 18 and the transfer roller 7.

1.6 Transfer Roller

The transfer roller 7 is a secondary transfer roller. The transfer roller 7 is configured to transfer the toner image transferred onto the transfer belt 18 onto a sheet. The transfer roller 7 is in contact with an outer surface of the transfer belt 18 in a state where the belt unit 6 is at the second accommodated position. Specifically, the transfer roller 7 nips the transfer belt 18 in cooperation with the driven roller 20. The transfer roller 7 is positioned below the belt unit 6 in a state where the belt unit 6 is at the second accommodated position. Specifically, the transfer roller 7 is positioned below the driven roller 20 in a state where the belt unit 6 is at the second accommodated position.

1.7 Fixing Device

The fixing device 8 is configured to heat and pressurize a sheet onto which the toner image has been transferred to fix the toner image onto the sheet. The fixing device 8 is positioned opposite to the drive roller 19 with respect to the driven roller 20 in the first direction. The fixing device 8 is spaced apart from the transfer roller 7 in the first direction.

1.8 Sheet Supply Tray

The sheet supply tray 9 is configured to accommodate therein sheets of paper. Specifically, the sheet supply tray 9 includes a storage portion 9A for accommodating sheets therein. The sheet supply tray 9 is movable relative to the main body casing 2 in the first direction. The sheet supply tray 9 is movable between an outside position at which the storage portion 9A is positioned outside the main body casing 2 and an inside position at which the storage portion 9A is positioned inside the main body casing 2. Thus, a user can replenish the storage portion 9A with sheets after moving the sheet supply tray 9 to the outside position. When the sheet supply tray 9 is at the inside position, the sheet supply tray 9 is positioned below the belt unit 6 at the second accommodated position.

1.9 Second Sheet Guide

The second sheet guide 10 is positioned below the belt unit 6 in a state where the belt unit 6 is at the second accommodated position. The second sheet guide 10 is positioned between the belt unit 6 and the sheet supply tray 9 in the vertical direction in a state where the belt unit 6 is at the second accommodated position. The second sheet guide 10 is positioned below the first sheet guide 11 and faces the first sheet guide 11 in a state where the belt unit 6 is at the second accommodated position. The second sheet guide 10 defines the sheet conveying path P in cooperation with the first sheet guide 11 in a state where the belt unit 6 is at the second accommodated position. The second sheet guide 10 includes the plurality of sheet conveying rollers 23. The sheet conveying rollers 23 are an example of a second sheet conveying roller.

The sheet conveying rollers 23 are arranged spaced apart from one another in the first direction. The sheet conveying rollers 23 are configured to convey a sheet along the sheet conveying path P toward the position between the transfer belt 18 and the transfer roller 7 in cooperation with the plurality of sheet conveying rollers 24. That is, the second sheet guide 10 is configured to convey a sheet along the sheet conveying path P toward the position between the transfer belt 18 and the transfer roller 7.

The sheets accommodated in the sheet supply tray 9 are each fed to the position between the transfer belt 18 and the transfer roller 7 at a predetermined timing while being guided by the first sheet guide 11 and the second sheet guide 10. As a result, a toner image is transferred onto the sheet. The sheet onto which the toner image has been transferred passes through the fixing device 8. At this time, the toner image is fixed onto the sheet. Thereafter, the sheet that has passed through the fixing device 8 is guided upward by a discharge guide 30 positioned at the main body casing 2 in a state where a second discharge tray 103 (described later) is at a closed position and is then discharged onto a discharge tray 2D positioned at an upper surface of the main body casing 2.

1.10 Waste Toner Box

Figure 7:
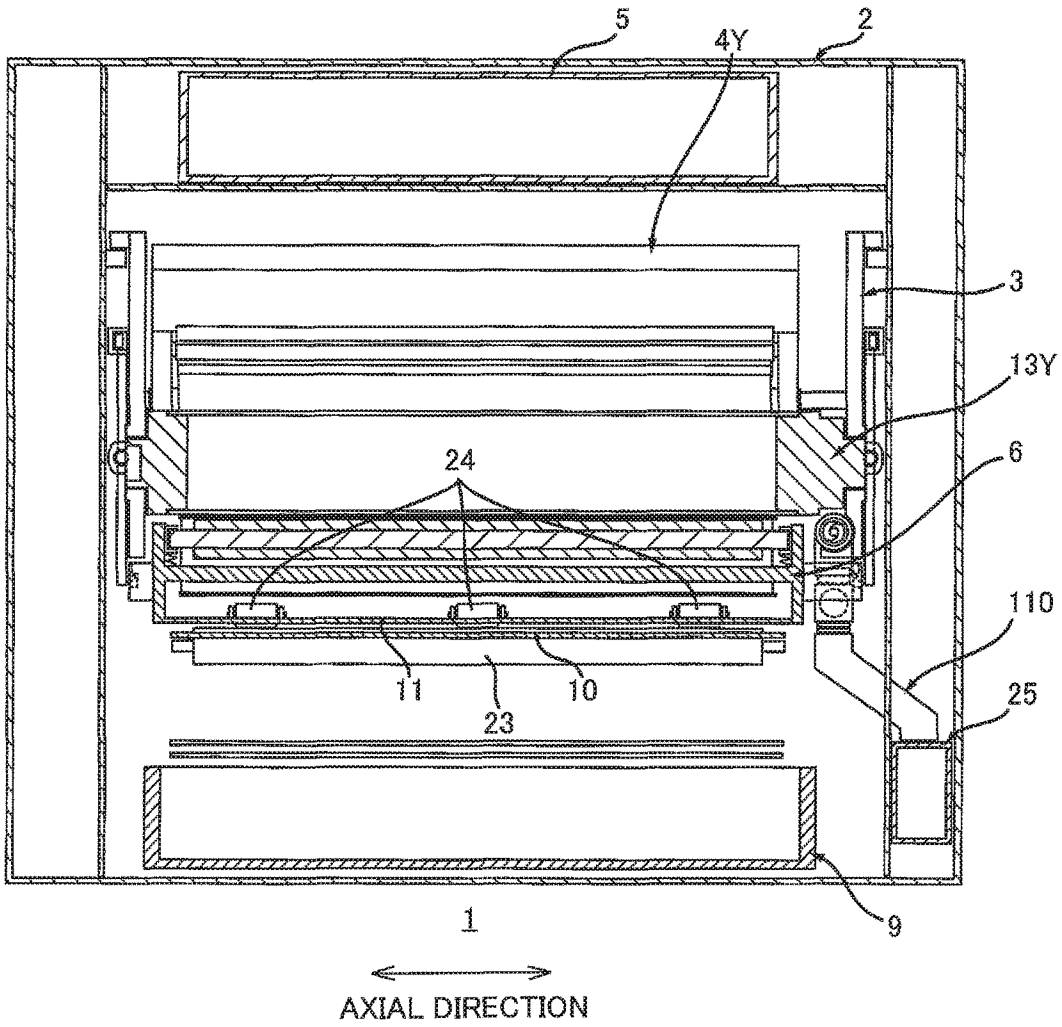
FIG. 7 is a cross-sectional view of the image forming apparatus according to the embodiment taken along a line C-C in FIG. 1.

As illustrated in FIG. 7, the waste toner box 25 is positioned in the main body casing 2. The toner removed by the drum cleaners 15K, 15Y, 15M, and 15C and the toner removed by the belt cleaner 22 are accommodated in the waste toner box 25.

2. Detailed Description of Image Forming Apparatus

Figures 2A, 2B, 2C:
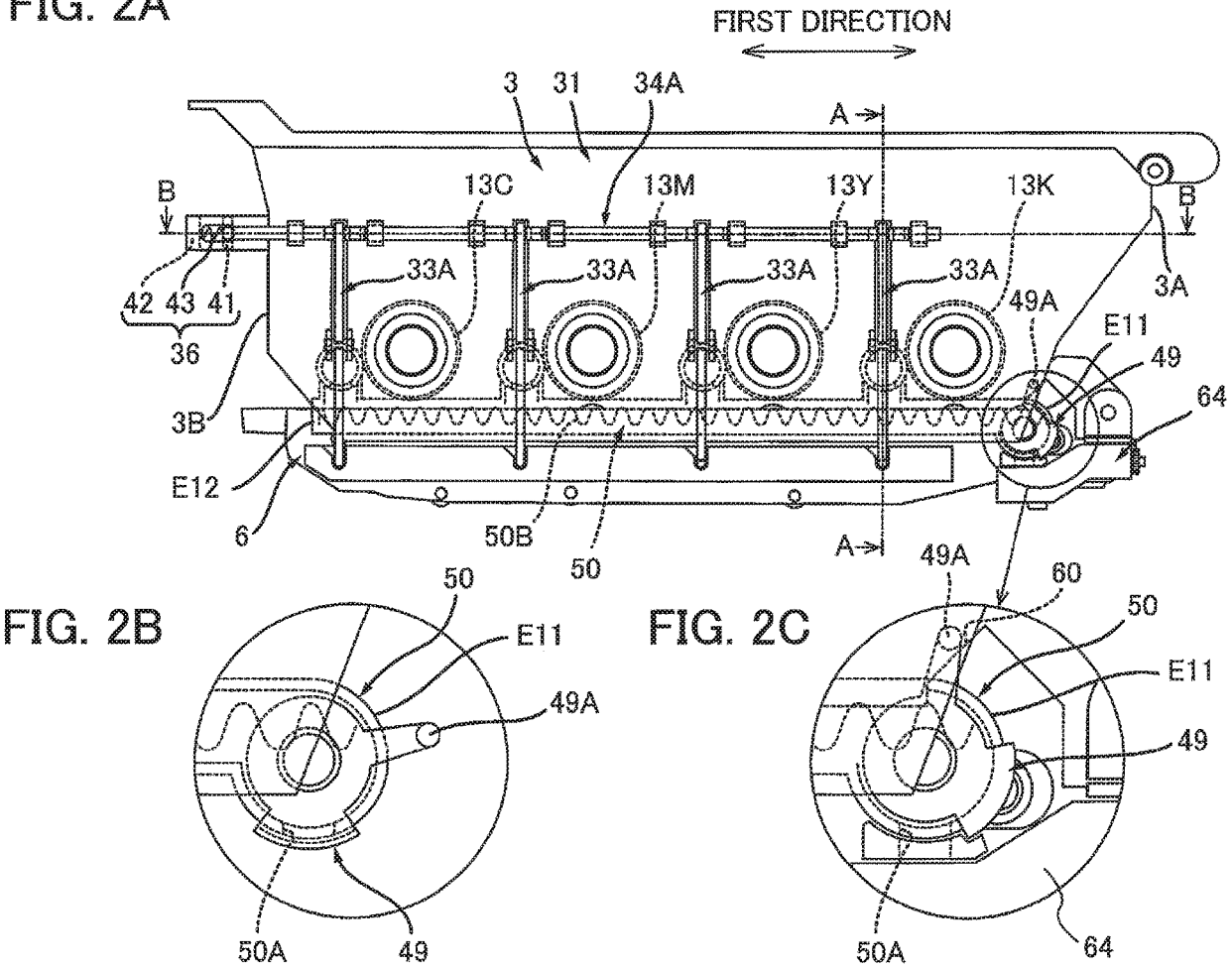
FIG. 2A is a side view of a drum unit and a belt unit of the image forming apparatus according to the embodiment, in which the drum unit and the belt unit are connected to each other.
FIG. 2B is an explanatory diagram for explaining an operation of a shutter of the image forming apparatus according to the embodiment, in which the shutter is at a closed position.
FIG. 2C is an explanatory diagram for explaining the operation of the shutter of the image forming apparatus according to the embodiment, in which the shutter is at an open position.
Figure 10:
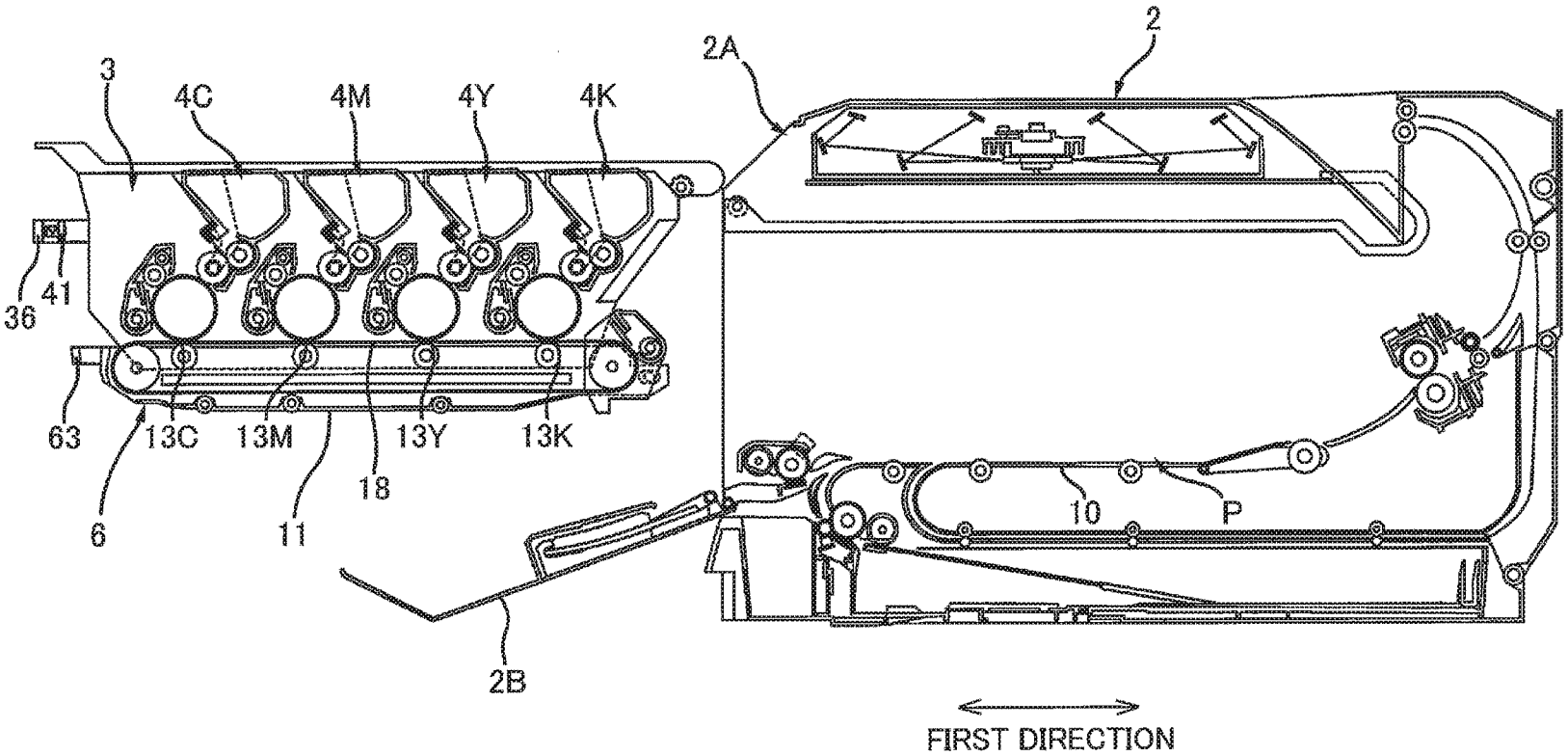
FIG. 10 is an explanatory diagram of the operation of the image forming apparatus according to the embodiment, in which the drum unit and the belt unit are at their respective withdrawn positions.

In the image forming apparatus 1, the belt unit 6 is movable from the second accommodated position to the second withdrawn position together with the drum unit 3 in a case where the drum unit 3 moves from the first accommodated position to the first withdrawn position, as illustrated in FIG. 10. Specifically, as illustrated in FIGS. 2A and 3A, the image forming apparatus 1 includes a plurality of levers 33A and a plurality of levers 33B as an example of a connector. The plurality of levers 33A and the plurality of levers 33B are configured to connect the drum unit 3 to the belt unit 6. In a case where the drum unit 3 moves from the first accommodated position to the first withdrawn position, the belt unit 6 is movable from the second accommodated position to the second withdrawn position in a state where the belt unit 6 is connected to the drum unit 3 by the levers 33A and the levers 33B. This allows the belt unit 6 including the first sheet guide 11 to be withdrawn from the main body casing 2 together with the drum unit 3 in one single operation. Thus, the sheet conveying path P can be easily opened.

Next, the drum unit 3 and the belt unit 6 will be described in detail.

2.1 Detailed Description of Drum Unit

With reference to FIGS. 2A through 4B, the drum unit 3 will be described in detail.

Figure 3A:
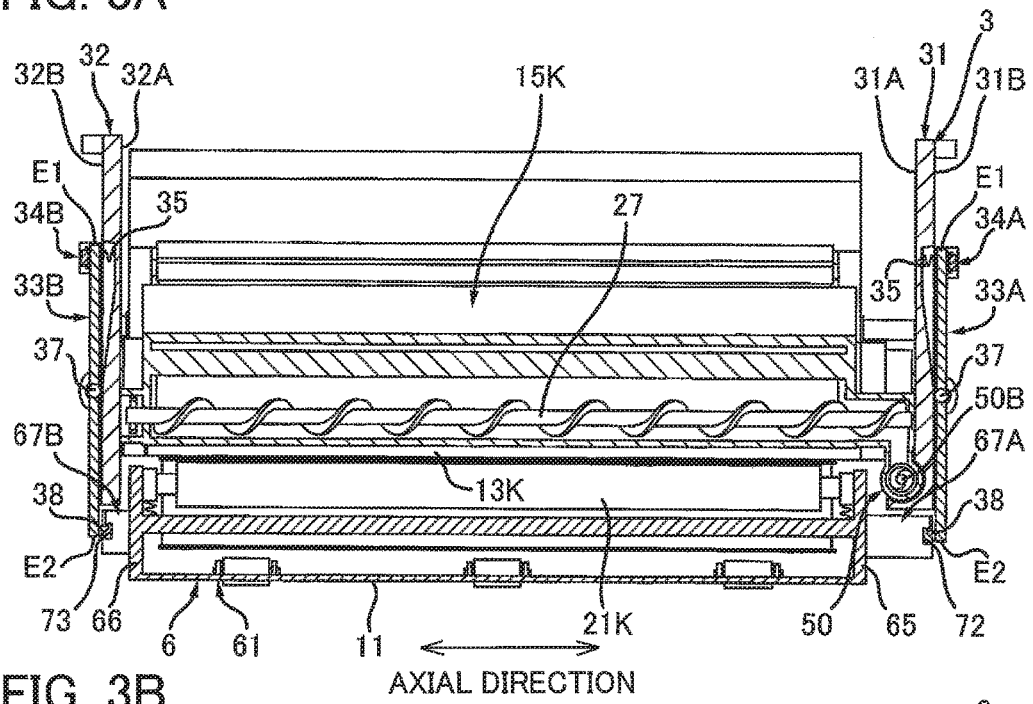
FIG. 3A is a cross-sectional view of the drum unit and the belt unit of the image forming apparatus according to the embodiment taken along a line A-A in FIG. 2A, in which a lever of the image forming apparatus is at an engagement position.
Figure 3B:
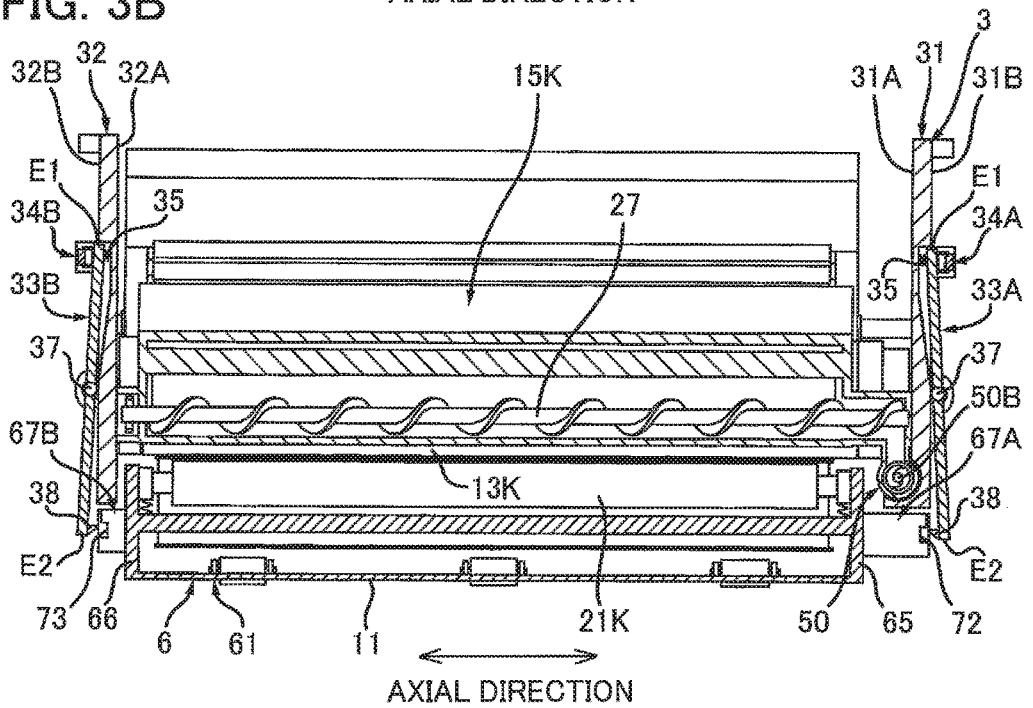
FIG. 3B is a cross-sectional view of the drum unit and the belt unit of the image forming apparatus according to the embodiment taken along the line A-A in FIG. 2A, in which the lever is at a disengagement position.

The plurality of levers 33A and the plurality of levers 33B are respectively movable between an engagement position (see FIG. 3A) and a disengagement position (see FIG. 3B). At the engagement position, the levers 33A and the levers 33B are respectively in engagement with the belt unit 6. At the disengagement position, the levers 33A and the levers 33B are respectively out of engagement with the belt unit 6.

The drum unit 3 includes a cam 34A, a cam 34B, and a first handle 36. The cam 34A is configured to move the levers 33A. The cam 34B is configured to move the levers 33B. The cam 34A and the cam 34B are an example of a link. The first handle 36 is connected to the cam 34A and the cam 34B. The drum unit 3 is configured such that a user's operation with the first handle 36 allows the levers 33A and the levers 33B to be moved between the engagement position and the disengagement position.

More specifically, as illustrated in FIGS. 2A and 3A, the drum unit 3 includes a first side frame 31, a second side frame 32, the plurality of levers 33A, the plurality of levers 33B, a plurality of springs 35, the cam 34A, the cam 34B, the first handle 36, the toner conveying tube 50, and a shutter 49.

The first side frame 31 extends in the first direction. The first side frame 31 has a flat plate-like shape. The first side frame 31 has a first surface 31A and a second surface 31B. The first surface 31A faces the second side frame 32. The second surface 31B is positioned opposite to the first surface 31A.

The second side frame 32 is positioned opposite to the first side frame 31 with respect to the photosensitive drums 13K, 13Y, 13M, and 13C in the axial direction. The second side frame 32 extends in the first direction. The second side frame 32 has a flat plate-like shape. The second side frame 32 has a first surface 32A and a second surface 32B. The first surface 32A faces the first side frame 31. The second surface 32B is positioned opposite to the first surface 32A.

2.1.1 Lever

The levers 33A and the levers 33B are configured to connect the drum unit 3 to the belt unit 6 in a state where the drum unit 3 is positioned above the belt unit 6 and where the transfer belt 18 is in contact with the photosensitive drums 13K, 13Y, 13M, and 13C.

The levers 33A are positioned at the second surface 31B of the first side frame 31. The levers 33A are arranged spaced apart from one another in the first direction. That is, the drum unit 3 includes at least a first lever 33A, and a second lever 33A positioned away from the first lever 33A in the first direction.

The levers 33B are positioned at the second surface 32B of the second side frame 32. The levers 33B are positioned opposite to the levers 33A with respect to the belt unit 6 in the axial direction. That is, the drum unit 3 includes at least a third lever 33B positioned opposite to the first lever 33A and the second lever 33A with respect to the belt unit 6 in the axial direction. The levers 33B are arranged spaced apart from one another in the first direction. The levers 33A and the levers 33B have the same structure as each other. Thus, the following description will be given with reference to one of the plurality of levers 33A, and description of the remaining levers 33A and the levers 33B will be omitted.

The lever 33A is pivotally movable between the engagement position and the disengagement position. The lever 33A extends in the vertical direction. The lever 33A has an upper end E1 and a lower end E2. The lower end E2 is positioned lower than a lower end of the first side frame 31. The lever 33A includes a pivot shaft 37 and a protrusion 38.

The pivot shaft 37 is positioned between the upper end E1 and the lower end E2 in the vertical direction. The pivot shaft 37 extends in the first direction. The pivot shaft 37 is rotatably attached to the first side frame 31. The lever 33A is pivotally movable about an axis of the pivot shaft 37.

The protrusion 38 is fitted in a recess 72 (described later) of the belt unit 6 in a case where the lever 33A is at the engagement position. As the protrusion 38 is fitted in the recess 72, the lever 33A engages with the belt unit 6. The protrusion 38 protrudes from the lower end E2 of the lever 33A. The protrusion 38 extends in the axial direction.

The lever 33A is urged by the spring 35 from the disengagement position toward the engagement position. The spring 35 is positioned between the upper end E1 of the lever 33A and the first side frame 31 in the axial direction. The spring 35 is a compression spring that extends in the axial direction. The spring 35 has one end and the other end in the axial direction. The one end of the spring 35 is in contact with the first side frame 31. The other end of the spring 35 is in contact with the upper end E1 of the lever 33A. The spring 35 is compressed at a higher pressure in a case where the lever 33A is at the disengagement position than at the engagement position. Thus, the spring 35 urges the lever 33A from the disengagement position toward the engagement position.

2.1.2 Cam

As illustrated in FIGS. 3A through 4B, the cam 34A is configured to move the levers 33A from the engagement position to the disengagement position. Specifically, the cam 34A is configured to press each of the levers 33A such that the upper end E1 of each lever 33A moves closer to the first side frame 31 to thereby move the levers 33A from the engagement position to the disengagement position. More specifically, the cam 34A presses each of the levers 33A at a portion thereof between the upper end E1 and the pivot shaft 37. As illustrated in FIG. 4A, the cam 34A is positioned opposite to the first side frame 31 with respect to the levers 33A in the axial direction. The cam 34A extends in the first direction. The cam 34A is movable in the first direction between a pressure position (see FIG. 4B) at which the cam 34A presses the levers 33A and a pressure release position (see FIG. 4A) at which pressure applied to the levers 33A by the cam 34A is released. That is, the moving direction of the cam 34A and the moving direction of the levers 33A differ from each other. The cam 34A has a plurality of cam surfaces 40A.

The number of the cam surfaces 40A corresponds to the number of the levers 33A. The cam surfaces 40A are arranged spaced apart from one another in the first direction. Each one of the plurality of cam surfaces 40A is capable of contacting corresponding one of the plurality of levers 33A. The cam surfaces 40A have the same structure as one another. Thus, the following description will be given with reference to one of the cam surfaces 40A, and description of the remaining cam surfaces 40A will be omitted.

The cam surface 40A is in contact with the corresponding lever 33A during the movement of the cam 34A from the pressure release position to the pressure position. The cam surface 40A has an upstream edge and a downstream edge in a moving direction of the cam 34A from the pressure release position to the pressure position. The cam surface 40A is sloped such that the upstream edge of the cam surface 40A is positioned closer to the first side frame 31 than the downstream edge of the cam surface 40A to the first side frame 31. With this structure, during the movement of the cam 34A from the pressure release position to the pressure position, the cam 34A presses the levers 33A toward the first side frame 31 with the cam surfaces 40A.

As illustrated in FIGS. 3A through 4B, the cam 34B is configured to move the levers 33B from the engagement position to the disengagement position. Specifically, the cam 34B is configured to press each of the levers 33B such that the upper end E1 of each lever 33B moves toward the second side frame 32 to thereby move the levers 33B from the engagement position to the disengagement position. More specifically, the cam 34B presses each of the levers 33B at a portion thereof between the upper end E1 and the pivot shaft 37. As illustrated in FIG. 4A, the cam 34B is positioned opposite to the second side frame 32 with respect to the levers 33B in the axial direction. The cam 34B extends in the first direction. The cam 34B is movable in the first direction between a pressure position (see FIG. 4B) at which the cam 34B presses the levers 33B and a pressure release position (see FIG. 4A) at which pressure applied to the levers 33B by the cam 34B is released. The cam 34B has a plurality of cam surfaces 40B.

The number of the cam surfaces 40B corresponds to the number of the levers 33B. The cam surfaces 40B are arranged spaced apart from one another in the first direction. Each one of the plurality of cam surfaces 40B is capable of contacting corresponding one of the plurality of levers 33B. The cam surfaces 40B have the same structure as one another. Thus, the following description will be given with reference to one of the cam surfaces 40B, and description of the remaining cam surfaces 40B will be omitted.

The cam surface 40B is in contact with the corresponding lever 33B during the movement of the cam 34B from the pressure release position to the pressure position. The cam surface 40B has an upstream edge and a downstream edge in the moving direction of the cam 34B from the pressure release position to the pressure position. The cam surface 40B is sloped such that the upstream edge of the cam surface 40B is positioned closer to the second side frame 32 than the downstream edge of the cam surface 40B to the second side frame 32. With this structure, during the movement of the cam 34B from the pressure release position to the pressure position, the cam 34B presses the levers 33B toward the second side frame 32 with the cam surfaces 40B.

2.1.3 First Handle

Figure 9:
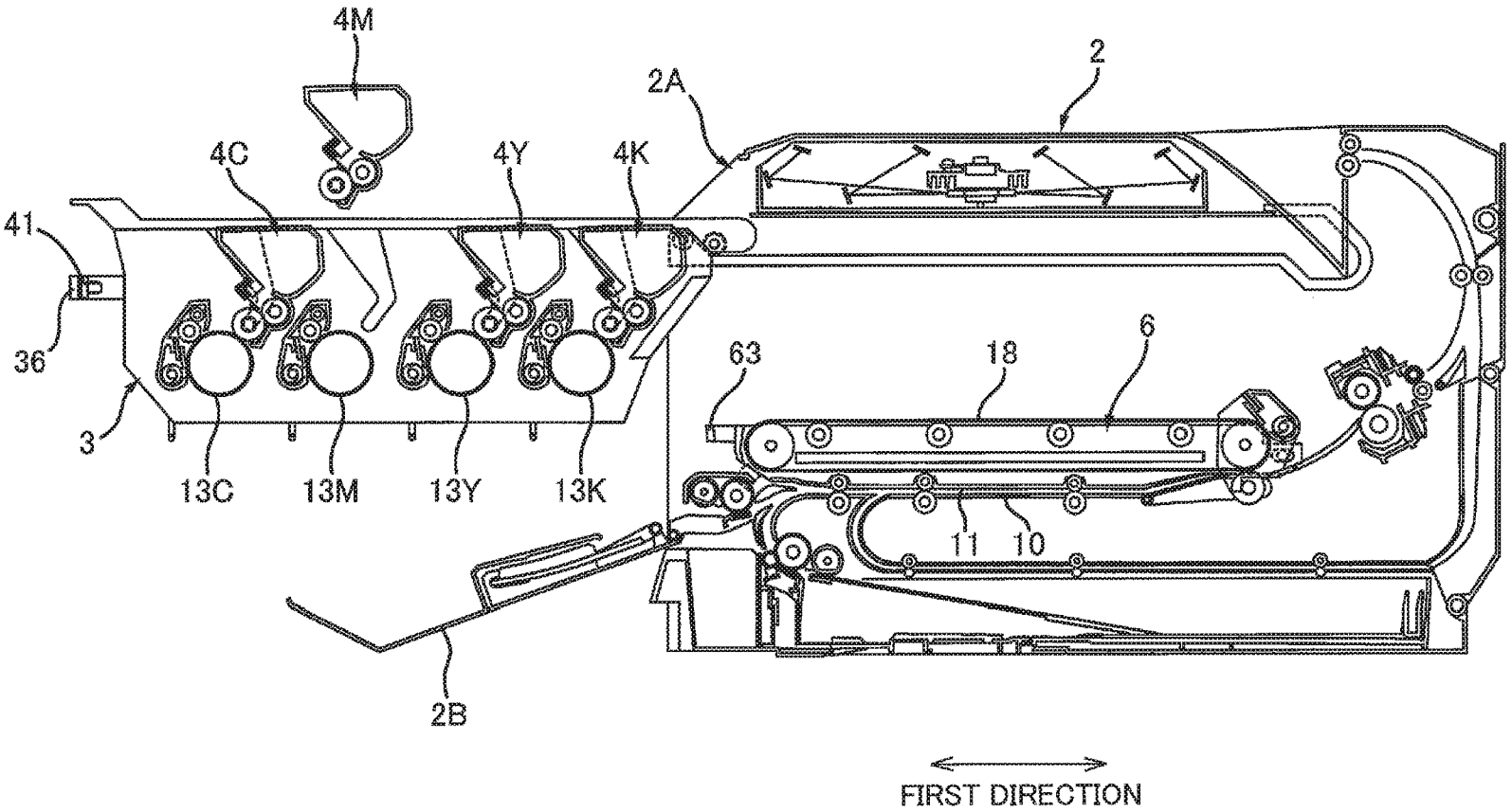
FIG. 9 is an explanatory diagram of an operation of the image forming apparatus according to the embodiment, in which the drum unit is moved to a withdrawn position while the belt unit is at an accommodated position.

As illustrated in FIG. 9, the first handle 36 is a handle for moving the drum unit 3 from the first accommodated position to the first withdrawn position. Specifically, the first handle 36 is a handle for moving the drum unit 3 from the first accommodated position to the first withdrawn position without moving the belt unit 6 from the second accommodated position to the second withdrawn position in a state where the drum unit 3 is at the first accommodated position and where the belt unit 6 is at the second accommodated position. As illustrated in FIG. 2A, the drum unit 3 has one end 3A and the other end 3B. The one end 3A of the drum unit 3 is positioned at an upstream side of the drum unit 3 in a withdrawal direction of the drum unit 3, i.e., in a direction in which the drum unit 3 moves from the first accommodated position to the first withdrawn position. The other end 3B of the drum unit 3 is positioned at a downtream side of the drum unit 3 in the withdrawal direction of the drum unit 3. The first handle 36 is positioned at the other end 3B. The first handle 36 is exposed to an outside through the opening 2A in a case where the front cover 2B is at the open position. The first handle 36 includes a first grip 41, a second grip 42, and a spring 43.

Figure 4A:
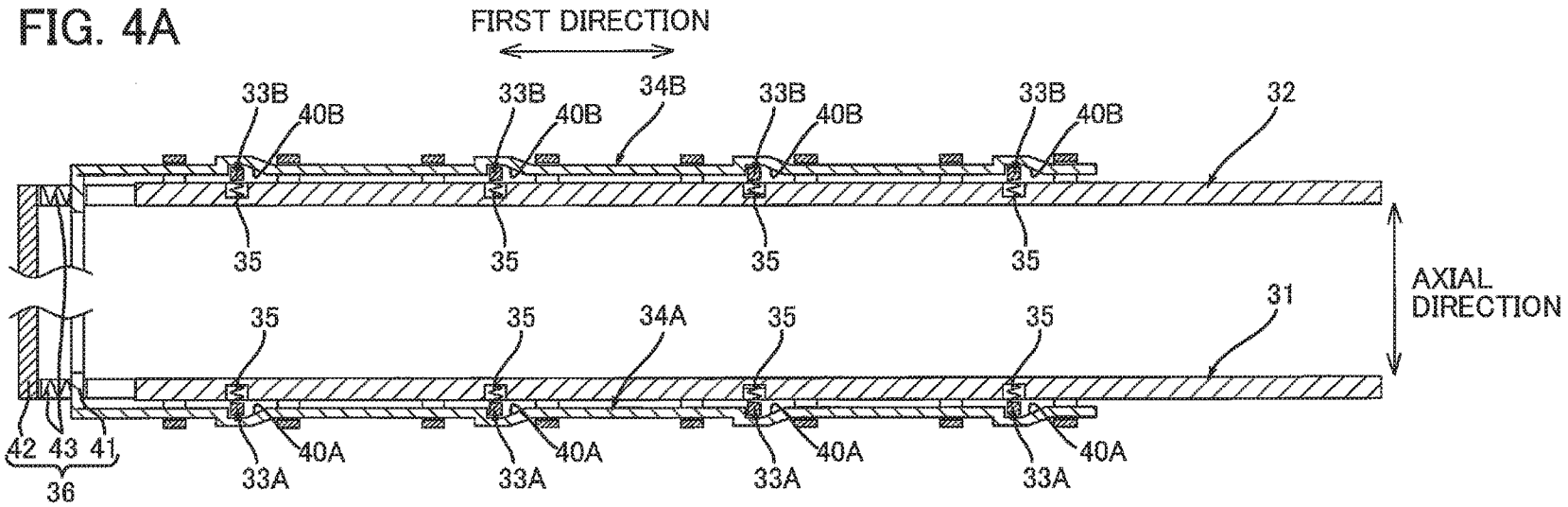
FIG. 4A is a cross-sectional view of the drum unit of the image forming apparatus according to the embodiment taken along a line B-B in FIG. 2A, in which a first grip of the drum unit is at a first position and a cam of the drum unit is at a pressure release position.

The first grip 41 is configured to move the levers 33A and the levers 33B from the engagement position to the disengagement position. Specifically, as illustrated in FIG. 4A, the first grip 41 is connected to both of the cam 34A and the cam 34B. More specifically, the first grip 41 extends in the axial direction. The first grip 41 has one end portion and the other end portion in the axial direction. The other end portion of the first grip 41 is positioned away from the one end portion of the first grip 41 in the axial direction. The one end portion of the first grip 41 is connected to the cam 34A. The other end portion of the first grip 41 is connected to the cam 34B. This allows the cam 34A and the cam 34B to be moved together with the first grip 41.

The first grip 41 is movable relative to the second grip 42 between a first position (see FIG. 4A) spaced apart from the second grip 42 and a second position (see FIG. 4B) closer to the second grip 42 than the first position is to the second grip 42. In a case where the first grip 41 is at the first position, the cam 34A and the cam 34B are at the pressure release position, and thus the levers 33A and the levers 33B are at the engagement position. In a case where the first grip 41 is at the second position, the cam 34A and the cam 34B are at the pressure position, and thus the levers 33A and the levers 33B are at the disengagement position.

That is, the cam 34A and the cam 34B move together with the first grip 41 in accordance with the movement of the first grip 41 from the first position to the second position. Further, the levers 33A move from the engagement position to the disengagement position in accordance with the movement of the cam 34A. Further, the levers 33B move from the engagement position to the disengagement position in accordance with the movement of the cam 34B. Thus, the levers 33A and the levers 33B move from the engagement position to the disengagement position in a case where the first grip 41 moves from the first position to the second position.

The second grip 42 faces the first grip 41 in the first direction. The second grip 42 is fixed to the other end 3B of the drum unit 3.

The spring 43 is positioned between the first grip 41 and the second grip 42. The spring 43 presses the first grip 41 from the second position toward the first position.

2.1.4 Toner Conveying Tube

As illustrated in FIGS. 2A and 3A, the toner conveying tube 50 is configured to convey the toner removed by the cleaning blade 26 toward the waste toner box 25. Specifically, the toner conveying tube 50 conveys the toner removed by the cleaning blade 26 toward the belt toner conveying tube 64. The toner conveying tube 50 extends in the first direction. The toner conveying tube 50 includes a screw 50B for conveying the toner. The screw 50B is positioned inside the toner conveying tube 50. The toner conveying tube 50 is connected to the drum cleaners 15K, 15Y, 15M, and 15C. The toner conveying tube 50 has one end portion E11 and the other end portion E12. The one end portion E11 of the toner conveying tube 50 is positioned at an upstream side of the toner conveying tube 50 in the withdrawal direction of the drum unit 3. The other end portion E12 of the toner conveying tube 50 is positioned at a downstream side of the toner conveying tube 50 in the withdrawal direction of the drum unit 3. The toner conveying tube 50 has a first toner discharge opening 50A. The first toner discharge opening 50A is positioned at the one end portion E11 of the toner conveying tube 50. The toner conveyed through the toner conveying tube 50 is discharged from the first toner discharge opening 50A.

Further, as illustrated in FIG. 3A, the toner conveying tube 50 is positioned at the first surface 31A of the first side frame 31. The toner conveying tube 50 is positioned between the levers 33A and a first wall 65 (described later) of the belt unit 6 in the axial direction in a state where the drum unit 3 is positioned above the belt unit 6 and where the transfer belt 18 is in contact with the photosensitive drums 13K, 13Y, 13M, and 13C. This configuration can prevent the toner conveying tube 50 from interfering with the movement of the levers 33A.

2.1.5 Shutter

As illustrated in FIGS. 2B and 2C, the shutter 49 is movable between an open position (see FIG. 2C) at which the first toner discharge opening 50A is opened and a closed position (see FIG. 2B) at which the first toner discharge opening 50A is closed. Specifically, the shutter 49 is pivotally movable between the open position and the closed position. The shutter 49 is located at the open position by contacting a portion of the belt unit 6 in a state where the drum unit 3 is positioned above the belt unit 6 and where the transfer belt 18 is in contact with the photosensitive drums 13K, 13Y, 13M, and 13C. The shutter 49 is located at the closed position in a state where the drum unit 3 is separated from the belt unit 6 and where the shutter 49 is out of contact with the portion of the belt unit 6. Specifically, a contact surface 60 (described later) serves as the portion of the belt unit 6. The shutter 49 has a protrusion 49A that is configured to contact the contact surface 60. The protrusion 49A extends from the shutter 49.

2.2 Detailed Description of Belt Unit

Figure 5:
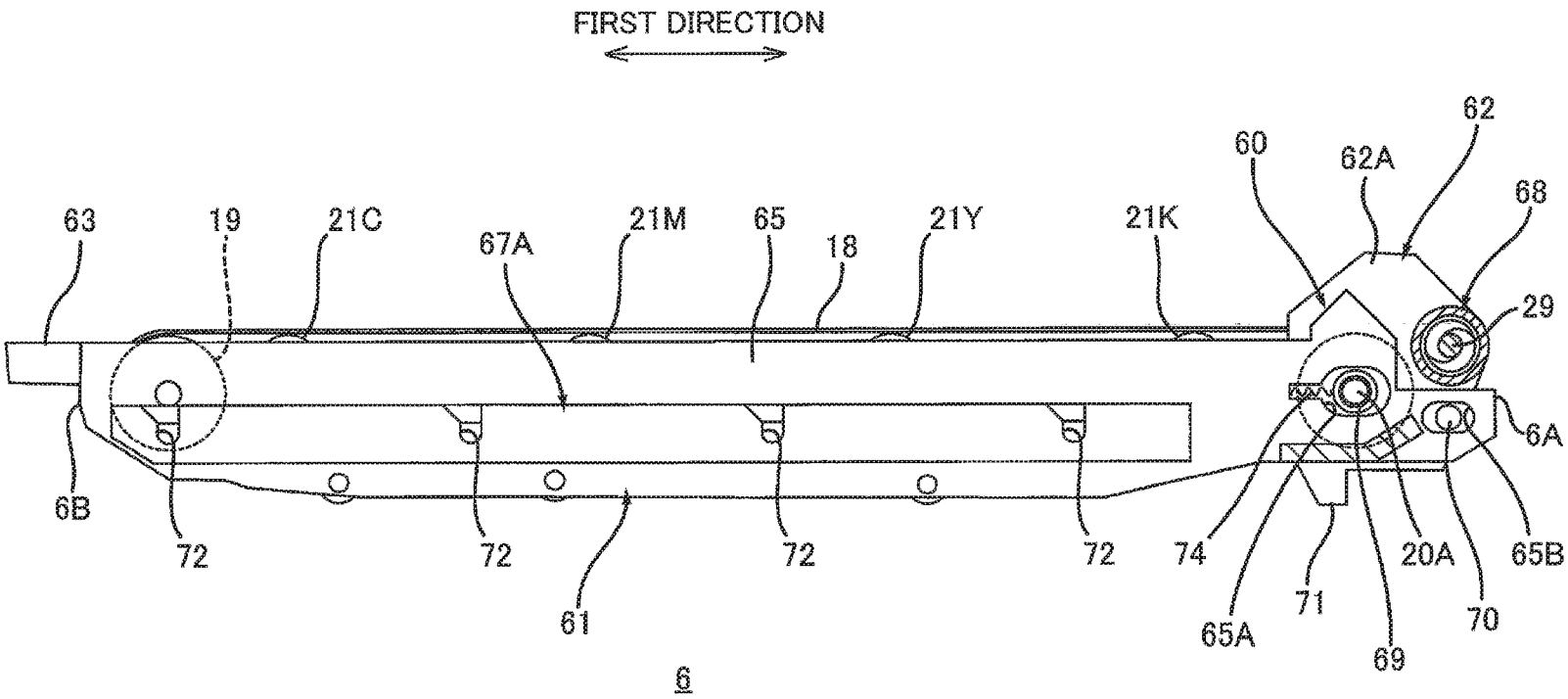
FIG. 5 is a cross-sectional view of the belt unit illustrated in FIG. 2A, in which cross-sections of a toner discharge portion and a belt toner conveying tube of the belt unit are illustrated so that a first elongated hole and a second elongated hole of the belt unit can be seen from an outside.

As illustrated in FIG. 5, the belt unit 6 includes a main frame 61, a sub-frame 62, a second handle 63, the belt toner conveying tube 64 (see FIG. 6), and the contact surface 60.

2.2.1 Main Frame

As illustrated in FIGS. 3A and 5, the main frame 61 supports the drive roller 19 and the primary transfer rollers 21K, 21Y, 21M, and 21C. Further, the main frame 61 includes the first wall 65, a second wall 66, an engagement portion 67A, an engagement portion 67B, and the first sheet guide 11.

As illustrated in FIG. 3A, the first wall 65 is positioned between the first side frame 31 and the second side frame 32 in the axial direction. As illustrated in FIG. 5, the first wall 65 extends in the first direction. The first wall 65 has a flat plate-like shape. The first wall 65 has a first elongated hole 65A and a second elongated hole 65B. The first elongated hole 65A and the second elongated hole 65B are elongated in the first direction. A first boss 69 (described later) of the sub-frame 62 is fitted in the first elongated hole 65A. A second boss 70 (described later) of the sub-frame 62 is fitted in the second elongated hole 65B. With this arrangement, the main frame 61 movably supports the sub-frame 62 in the first direction.

As illustrated in FIG. 3A, the second wall 66 is positioned between the first wall 65 and the second side frame 32 in the axial direction. The second wall 66 is spaced apart from the first wall 65 in the axial direction. The second wall 66 is positioned opposite to the first wall 65 with respect to the primary transfer rollers 21K, 21Y, 21M, and 21C in the axial direction. The second wall 66 is positioned opposite to the first wall 65 with respect to the drive roller 19 in the axial direction. The second wall 66 extends in the first direction. The second wall 66 has a flat plate-like shape. The second wall 66 has at least a third elongated hole (not illustrated) having the same shape as the shape of the first elongated hole 65A. The second wall 66 may have a fourth elongated hole (not illustrated) having the same shape as the shape of the second elongated hole 65B.

As illustrated in FIG. 3A, the engagement portion 67A engages with the levers 33A in a case where the levers 33A are each at the engagement position in a state where the drum unit 3 is positioned above the belt unit 6 and where the transfer belt 18 is in contact with the photosensitive drums 13K, 13Y, 13M, and 13C. The engagement portion 67A is positioned opposite to the second wall 66 with respect to the first wall 65 in the axial direction. The engagement portion 67A protrudes in the axial direction from the first wall 65. As illustrated in FIG. 5, the engagement portion 67A extends in the first direction. The engagement portion 67A has a plurality of recesses 72.

The number of the recesses 72 corresponds to the number of the levers 33A. The recesses 72 are arranged spaced apart from one another in the first direction. As illustrated in FIG. 3A, the protrusion 38 of one of the plurality of levers 33A is fitted in corresponding one of the plurality of recesses 72. The recesses 72 are each positioned at a protruding end of the engagement portion 67A in the axial direction. The recesses 72 are each recessed in the axial direction from the protruding end of the engagement portion 67A toward the first wall 65.

As illustrated in FIG. 3A, the engagement portion 67B engages with the levers 33B in a case where the levers 33B are each at the engagement position in a state where the drum unit 3 is positioned above the belt unit 6 and where the transfer belt 18 is in contact with the photosensitive drums 13K, 13Y, 13M, and 13C. The engagement portion 67B is positioned opposite to the first wall 65 with respect to the second wall 66 in the axial direction. The engagement portion 67B protrudes in the axial direction from the second wall 66. The engagement portion 67B extends in the first direction. The engagement portion 67B has a plurality of recesses 73.

The number of the recesses 73 corresponds to the number of the levers 33B. The recesses 73 are arranged spaced apart from one another in the first direction. The protrusion 38 of one of the plurality of levers 33B is fitted in corresponding one of the plurality of recesses 73. The recesses 73 are each positioned at a protruding end of the engagement portion 67B in the axial direction. The recesses 73 are each recessed in the axial direction from the protruding end of the engagement portion 67B toward the second wall 66.

As illustrated in FIG. 3A, the first sheet guide 11 is positioned at a lower end portion of the main frame 61. The first sheet guide 11 is positioned between the first wall 65 and the second wall 66 in the axial direction. The first sheet guide 11 extends in the axial direction and the first direction. The first sheet guide 11 has a flat plate-like shape. The first sheet guide 11 has one end portion and the other end portion in the axial direction. The other end portion of the first sheet guide 11 is positioned away from the one end portion of the first sheet guide 11 in the axial direction. The one end portion of the first sheet guide 11 is connected to the first wall 65. The other end portion of the first sheet guide 11 is connected to the second wall 66. Thus, during the movement of the belt unit 6 between the second accommodated position and the second withdrawn position, the first sheet guide 11 is movable together with the transfer belt 18.

2.2.2 Sub-Frame

As illustrated in FIG. 5, the sub-frame 62 is movable relative to the main frame 61. The belt cleaner 22 (see FIG. 1) is positioned inside the sub-frame 62. That is, the sub-frame 62 supports the belt cleaning blade 28 and the auger screw 29. The sub-frame 62 is positioned between the first wall 65 and the second wall 66 in the axial direction. The sub-frame 62 extends in the axial direction. The sub-frame 62 has one end portion 62A and the other end portion (not illustrated) in the axial direction. The other end portion of the sub-frame 62 is positioned opposite to the one end portion 62A of the sub-frame 62 in the axial direction. The sub-frame 62 includes the first boss 69, the second boss 70, a toner discharge portion 68, and a protrusion 71.

The first boss 69 protrudes from the one end portion 62A of the sub-frame 62. The first boss 69 extends in the axial direction. The first boss 69 has a hollow cylindrical shape. One end portion of a shaft 20A of the driven roller 20 is fitted in the first boss 69. Incidentally, the other end portion (not illustrated) of the sub-frame 62 includes a third boss (not illustrated) having the same structure as the first boss 69. The other end portion of the shaft 20A of the driven roller 20 is fitted in the third boss. The sub-frame 62 supports the driven roller 20 by the shaft 20A fitted in the first boss 69 and the third boss. Further, the first boss 69 is fitted in the first elongated hole 65A of the first wall 65. The third boss is fitted in the third elongated hole of the second wall 66. As the first boss 69 and the third boss are fitted in the first elongated hole 65A and the third elongated hole, respectively, the sub-frame 62 is movable in the first direction relative to the main frame 61. The first boss 69 is pressed by a spring 74 in a direction parallel to the first direction and away from the drive roller 19. The third boss is pressed by a spring (not illustrated) in the direction parallel to the first direction and away from the drive roller 19. Thus, the driven roller 20 is pressed in the direction parallel to the first direction and away from the drive roller 19. As a result, a predetermined tension is applied to the transfer belt 18.

The second boss 70 protrudes from the one end portion 62A of the sub-frame 62. The second boss 70 is spaced apart from the first boss 69. The second boss 70 extends in the axial direction. The second boss 70 has a columnar shape. The second boss 70 is fitted in the second elongated hole 65B of the first wall 65. This prevents the sub-frame 62 from rotating about the first boss 69. Hence, the belt cleaning blade 28 (see FIG. 1) can be brought into contact with the transfer belt 18 reliably. In a case where the second wall 66 has the fourth elongated hole, the other end portion of the sub-frame 62 includes the fourth boss having the same structure as the second boss 70. In this case, the fourth boss may be fitted in the fourth elongated hole.

Figure 6:
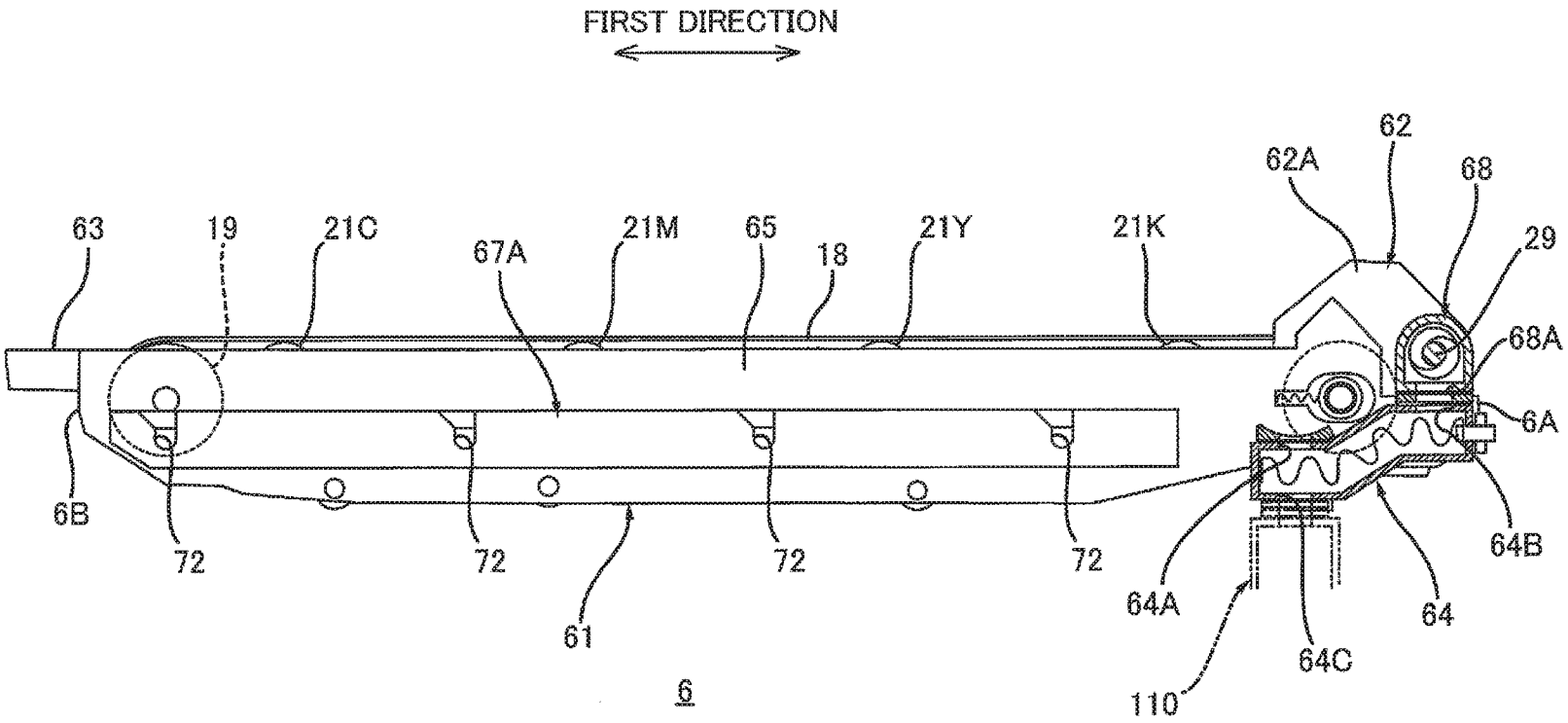
FIG. 6 is a cross-sectional view of the belt unit illustrated in FIG. 2A, in which cross-sections of the toner discharge portion and the belt toner conveying tube of the belt unit are illustrated so that a first toner receiving opening and a second toner receiving opening of the belt unit can be seen from an outside.

The toner discharge portion 68 is configured to discharge toner removed by the belt cleaning blade 28. The toner discharge portion 68 protrudes from the one end portion 62A of the sub-frame 62. The toner discharge portion 68 extends in the axial direction. The toner discharge portion 68 has a hollow cylindrical shape. The auger screw 29 is positioned inside the toner discharge portion 68. As illustrated in FIG. 6, the toner discharge portion 68 has an opening 68A. The opening 68A allows toner conveyed by the auger screw 29 to be discharged therethrough.

Figure 8:
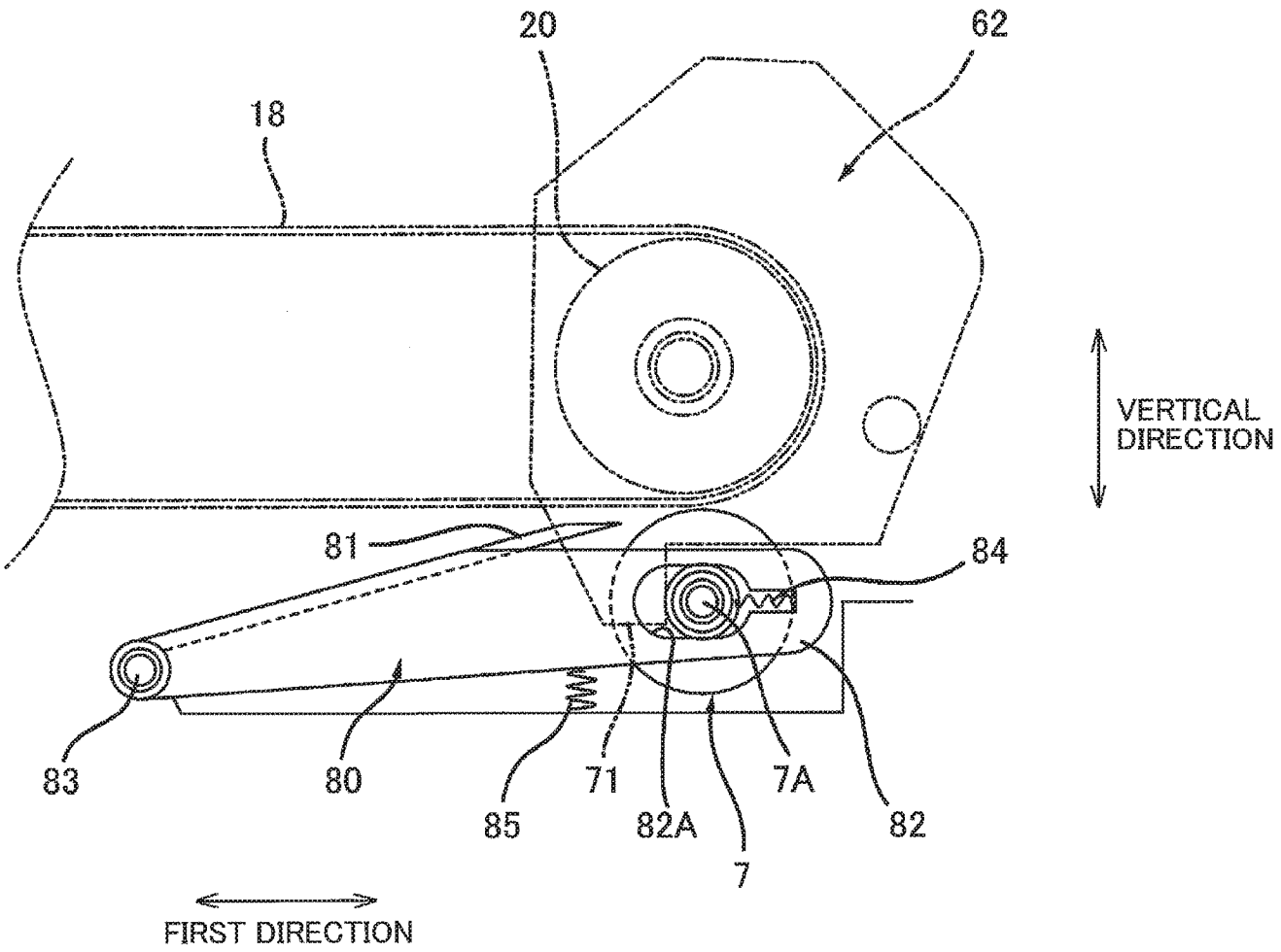
FIG. 8 is an explanatory diagram of a transfer roller support member of a main body casing of the image forming apparatus according to the embodiment.

As illustrated in FIG. 8, the protrusion 71 is in contact with a shaft 7A of the transfer roller 7 in a case where the belt unit 6 is at the second accommodated position. The protrusion 71 protrudes downward from the sub-frame 62. The protrusion 71 extends in the vertical direction.

2.2.3 Second Handle

As illustrated in FIGS. 9 and 10, the second handle 63 is a handle for moving the belt unit 6 from the second accommodated position to the second withdrawn position. As illustrated in FIG. 5, the belt unit 6 has one end 6A and the other end 6B. The one end 6A of the belt unit 6 is positioned at an upstream side of the belt unit 6 in the withdrawal direction of the drum unit 3. The other end 6B of the belt unit 6 is positioned at a downstream side of the belt unit 6 in the withdrawal direction of the drum unit 3. The second handle 63 is positioned at the other end 6B. The second handle 63 is exposed to an outside through the opening 2A in a case where the front cover 2B is at the open position. The belt unit 6 is movable by the second handle 63 together with the drum unit 3 in a state where the drum unit 3 is positioned above the belt unit 6 and where the transfer belt 18 is in contact with the photosensitive drums 13K, 13Y, 13M, and 13C.

2.2.4 Belt Toner Conveying Tube

As illustrated in FIG. 6, the belt toner conveying tube 64 is attached to the first wall 65 of the main frame 61. Thus, the main frame 61 supports the belt toner conveying tube 64. The belt toner conveying tube 64 extends in the first direction. The belt toner conveying tube 64 is configured to receive toner removed by the belt cleaning blade 28 (see FIG. 1). The belt toner conveying tube 64 is also configured to receive toner conveyed through the toner conveying tube 50 (see FIG. 2A). The belt toner conveying tube 64 has a first toner receiving opening 64A, a second toner receiving opening 64B, and a second toner discharge opening 64C. The first toner receiving opening 64A and the second toner receiving opening 64B are an example of a toner receiving opening.

The first toner receiving opening 64A is in communication with the first toner discharge opening 50A of the toner conveying tube 50 in a state where the drum unit 3 is at the first accommodated position and where the belt unit 6 is at the second accommodated position. In this state, the first toner receiving opening 64A can receive toner conveyed through the toner conveying tube 50.

The second toner receiving opening 64B is in communication with the opening 68A of the sub-frame 62. Thus, the second toner receiving opening 64B can receive toner removed by the belt cleaning blade 28. The second toner receiving opening 64B is spaced apart from the first toner receiving opening 64A in the first direction.

The second toner discharge opening 64C is an opening for discharging toner in the belt toner conveying tube 64. The second toner discharge opening 64C is in communication with the waste toner box 25 in a state where the belt unit 6 is at the second accommodated position. Specifically, as illustrated in FIGS. 6 and 7, the second toner discharge opening 64C is in communication with the waste toner box 25 through a main body toner conveying tube 110 in a state where the belt unit 6 is at the second accommodated position. With this configuration, toner discharged from the second toner discharge opening 64C is accommodated in the waste toner box 25 through the main body toner conveying tube 110.

2.2.5 Contact Surface

As illustrated in FIG. 2C, the contact surface 60 is in contact with the protrusion 49A of the shutter 49 in a state where the drum unit 3 and the belt unit 6 are connected to each other to locate the shutter 49 at the open position. The contact surface 60 contacts the shutter 49 in a case where the drum unit 3 moves from the first withdrawn position to the first accommodated position in a state where the belt unit 6 is at the second accommodated position. As a result, the contact surface 60 moves the shutter 49 from the closed position to the open position. The contact surface 60 maintains the contact with the shutter 49 so that the shutter 49 is held at the open position in a case where the belt unit 6 moves from the second accommodated position to the second withdrawn position together with the drum unit 3. As illustrated in FIG. 5, the contact surface 60 constitutes a portion of the main frame 61. Specifically, the contact surface 60 constitutes a portion of the first wall 65 of the main frame 61. The contact surface 60 is positioned at an upper end portion of the first wall 65.

2.3 Transfer Roller Support Member

As illustrated in FIG. 8, the main body casing 2 includes a transfer roller support member 80. The transfer roller support member 80 supports the transfer roller 7. The transfer roller support member 80 is pivotally movable about a pivot axis 83 that extends in the axial direction. The transfer roller support member 80 includes a third sheet guide 81, an arm 82, a first spring 84, and a second spring 85. The third sheet guide 81 constitutes a portion of the second sheet guide 10. The arm 82 supports the transfer roller 7.

The third sheet guide 81 is configured to guide a sheet conveyed by the sheet conveying rollers 23 (see FIG. 1) and the sheet conveying rollers 24 (see FIG. 1) to a position between the transfer belt 18 and the transfer roller 7.

The arm 82 extends from the third sheet guide 81 toward the transfer roller 7. The arm 82 has an elongated hole 82A that is elongated in the first direction. The elongated hole 82A receives the shaft 7A of the transfer roller 7. With this configuration, the transfer roller 7 is rotatably supported by the arm 82 and movable in the first direction.

The first spring 84 presses the shaft 7A of the transfer roller 7 in the withdrawal direction of the drum unit 3. The first spring 84 is positioned in the elongated hole 82A. The first spring 84 is in contact with the shaft 7A.

The second spring 85 presses the arm 82 upward. Thus, in a case where the belt unit 6 is at the second accommodated position, the transfer roller 7 is pressed toward the transfer belt 18. That is, the transfer roller 7 is urged toward the transfer belt 18 in the vertical direction. The second spring 85 is positioned below the arm 82. The second spring 85 is in contact with the arm 82.

In a case where the belt unit 6 is at the second accommodated position, the protrusion 71 of the sub-frame 62 is positioned opposite to the first spring 84 with respect to the shaft 7A in the first direction. The protrusion 71 is in contact with the shaft 7A. Thus, in a case where the sub-frame 62 moves in the direction parallel to the first direction and away from the drive roller 19, the protrusion 71 presses the shaft 7A, whereby the transfer roller 7 moves, together with the sub-frame 62, in the direction parallel to the first direction and away from the drive roller 19 against the pressing force of the first spring 84. On the other hand, in a case where the sub-frame 62 moves in a direction parallel to the first direction and toward the drive roller 19, the first spring 84 presses the shaft 7A, whereby the transfer roller 7 moves, together with the sub-frame 62, in the direction parallel to the first direction and toward the drive roller 19. As described above, the transfer roller 7 is movable in the first direction together with the sub-frame 62. As a result, the position of the transfer roller 7 relative to the driven roller 20 can be maintained in a configuration where the driven roller 20 is movable relative to the drive roller 19.

3. Operation of Moving Drum Unit 3

Next, an operation of moving the drum unit 3 from the first accommodated position to the first withdrawn position in a state where the belt unit 6 is at the second accommodated position will be described.

Figure 4B:
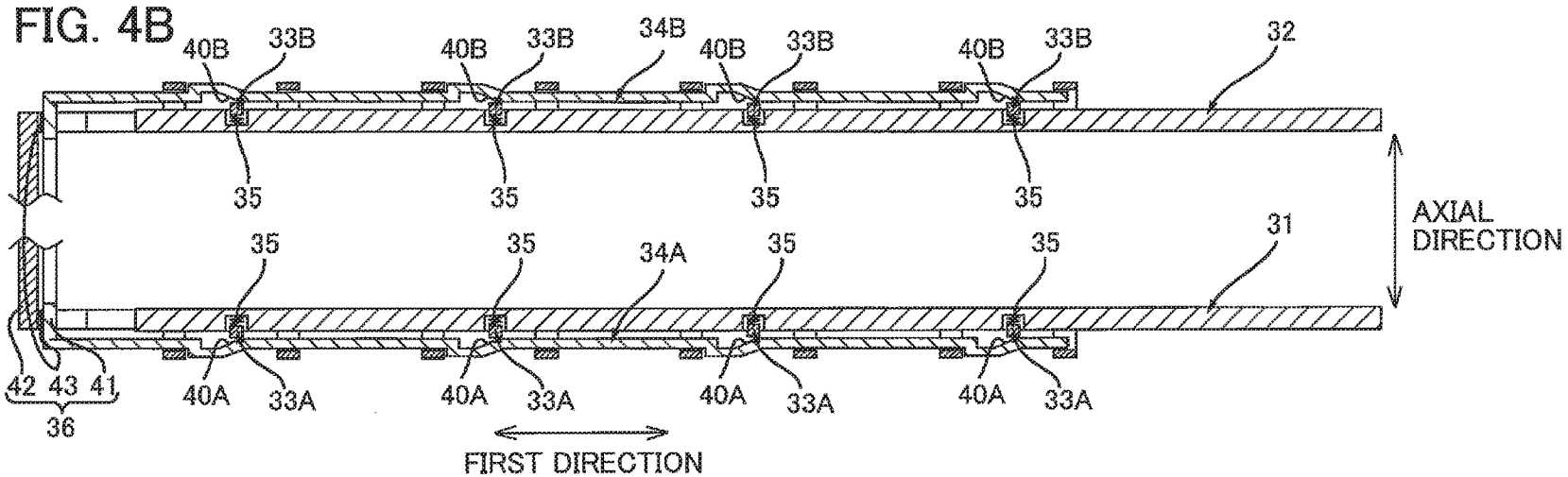
FIG. 4B is a cross-sectional view of the drum unit of the image forming apparatus according to the embodiment taken along the line B-B in FIG. 2A, in which the first grip of the drum unit is at a second position and the cam of the drum unit is at a pressure position.

In order to move the drum unit 3 from the first accommodated position to the first withdrawn position in a state where the belt unit 6 is at the second accommodated position as illustrated in FIG. 9, a user holds the first handle 36 without holding the second handle 63 to move the first grip 41 from the first position to the second position as illustrated in FIG. 4B.

Then, in accordance with the movement of the first grip 41 from the first position to the second position, the cam 34A and the cam 34B moves from the pressure release position to the pressure position.

Then, the levers 33A are pressed by the cam surfaces 40A of the cam 34A to be moved from the engagement position to the disengagement position. Similarly, the levers 33B are pressed by the cam surfaces 40B of the cam 34B to be moved from the engagement position to the disengagement position.

As a result, as illustrated in FIG. 3B, engagement between the levers 33A and the belt unit 6 and engagement between the levers 33B and the belt unit 6 are released.

Thereafter, as the user pulls the first handle 36 in a state where the first grip 41 is at the second position, the drum unit 3 moves from the first accommodated position to the first withdrawn position in a state where the belt unit 6 is at the second accommodated position, as illustrated in FIG. 9.

4. Operation of Withdrawing Belt Unit 6

Next, an operation of withdrawing the belt unit 6 and the drum unit 3 together from the main body casing 2 will be described.

In order to withdraw the drum unit 3 at the first accommodated position and the belt unit 6 at the second accommodated position from the main body casing 2 in a state where the drum unit 3 and the belt unit 6 are connected to each other as illustrated in FIG. 10, the user pulls the second handle 63 without holding the first handle 36.

At this time, the first grip 41 is at the first position, so that the levers 33 and the levers 33B connect the drum unit 3 to the belt unit 6, as illustrated in FIG. 3A. That is, the levers 33A and the levers 33B connect the drum unit 3 to the belt unit 6 during the movement of the drum unit 3 from the first accommodated position to the first withdrawn position.

Thus, the belt unit 6 moves, together with the drum unit 3, from the second accommodated position to the second withdrawn position as illustrated in FIG. 10 in a state where the levers 33A and the levers 33B are at the engagement position.

Further, at this time, the first sheet guide 11 is withdrawn to an outside of the main body casing 2 together with the transfer belt 18. Accordingly, the first sheet guide 11 is separated away from the second sheet guide 10 such that the sheet conveying path P is exposed to the opening 2A of the main body casing 2 in a case where the drum unit 3 moves from the first accommodated position to the first withdrawn position and where the belt unit 6 moves from the second accommodated position to the second withdrawn position.

5. Operational Advantages

According to the image forming apparatus 1, the belt unit 6 including the first sheet guide 11 can be withdrawn from the main body casing 2 together with the drum unit 3 as illustrated in FIG. 10 by a single operation of moving the drum unit 3 from the first accommodated position to the first withdrawn position.

Thus, in a case where a sheet is jammed in the sheet conveying path P, the sheet conveying path P can be smoothly opened by the operation of moving the drum unit 3 from the first accommodated position to the first withdrawn position, thereby allowing the jammed sheet to be removed.

6. Further Details of Image Forming Apparatus

Figure 11:
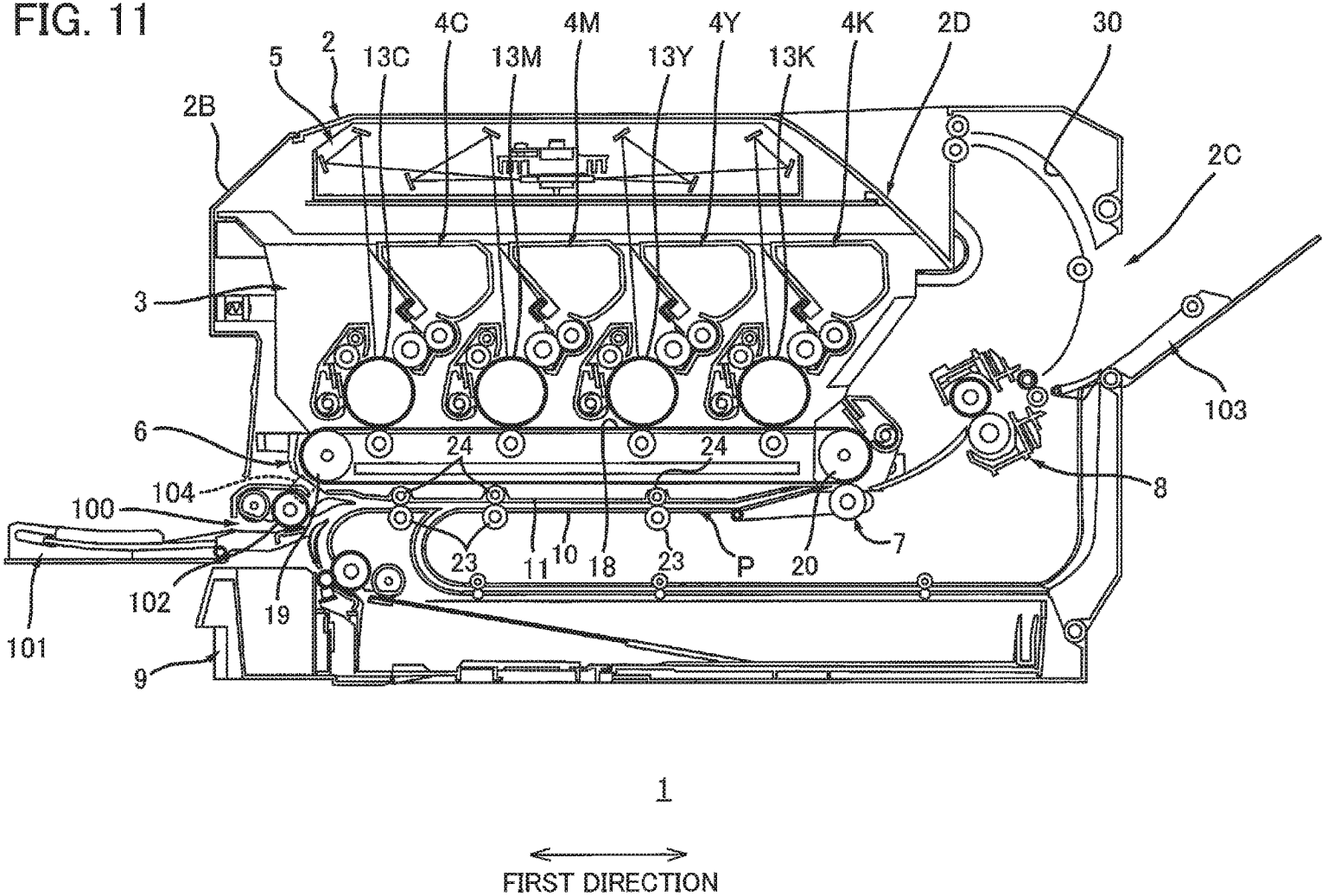
FIG. 11 is an explanatory diagram for further explaining the image forming apparatus according to the embodiment, in which a second sheet supply tray and a second discharge tray of the main body casing are at their respective open positions.

As illustrated in FIG. 11, the image forming apparatus 1 further includes a second sheet supply tray 101, a second supply roller 102, a second discharge tray 103, and a sensor 104.

The second sheet supply tray 101 is attached to the front cover 2B. The second sheet supply tray 101 is movable between a closed position (see FIG. 1) at which an opening 100 of the front cover 2B is closed and an open position (see FIG. 11) at which the opening 100 is opened. Sheets of paper can be placed on the second sheet supply tray 101 in a state where the second sheet supply tray 101 is at the open position. The second sheet supply tray 101 at the open position is positioned opposite to the fixing device 8 with respect to the first sheet guide 11 in the first direction. The second sheet supply tray 101 at the open position extends in the first direction.

The second supply roller 102 is configured to convey the sheets placed on the second sheet supply tray 101 to a position between the first sheet guide 11 and the second sheet guide 10. The second supply roller 102 is positioned between the second sheet supply tray 101 and the first sheet guide 11 in the first direction.

The second discharge tray 103 is a tray on which a sheet that has passed through the fixing device 8 is placed. The second discharge tray 103 is configured to suppress the sheet that has passed through the fixing device 8 from curling. The sheet that has passed through the fixing device 8 is discharged on the second discharge tray 103. The second discharge tray 103 is positioned opposite to the transfer roller 7 with respect to the fixing device 8 in the first direction. The second discharge tray 103 is movable between an open position at which a second opening 2C of the main body casing 2 is opened and a closed position at which the second opening 2C is closed. The second discharge tray 103 at the open position extends in the first direction. Specifically, the second discharge tray 103 at the open position extends in a direction of a sheet passing through the fixing device 8.

The sensor 104 is configured to inspect the surface of the transfer belt 18. The sensor 104 is positioned below the drive roller 19. The sensor 104 faces the surface of the transfer belt 18. The sensor 104 and the second supply roller 102 are arrayed in the axial direction.

The sensor 104 is used mainly for color shift correction, color correction, and the like. However, the sensor 104 may be used also for adjustment of sheet conveying timing.

By measuring a leading end of a toner image or a marking formed on the surface of the transfer belt 18, the timing of the sheet conveying rollers 23 and the sheet conveying rollers 24 can be adjusted, whereby accurate positioning of an image to be formed on a sheet can be performed.

More specifically, the sheet conveying roller 23 and the sheet conveying roller 24 positioned closest to the transfer roller 7 are made to function as a registration roller pair. Hence, a sheet can be fed to a position between the transfer roller 7 and the transfer belt 18 in timed relation with a signal from the sensor 104.

At this time, a lower portion of the outer surface of the transfer belt 18, that is, a portion of the outer surface of the transfer belt 18 that is not in contact with the photosensitive drums 13K, 13Y, 13M, and 13C is moved in the first direction toward a position between the transfer belt 18 and the transfer roller 7 in the same manner as the sheet conveyed on the sheet conveying path P constituted by the first sheet guide 11 and the second sheet guide 10 is.

Further, the transfer roller 7 is in contact with the lower portion of the outer surface of the transfer belt 18 from below. Hence, the sheet and the transfer belt 18 are moved to the position between the transfer belt 18 and the transfer roller 7 substantially in the first direction without curving.

Thus, even if the driven roller 20 and the transfer roller 7 move in the first direction, a variation in the distance from the sheet conveying rollers 23 and 24 positioned closest to the transfer roller 7 to the position between the transfer belt 18 and the transfer roller 7 is substantially equal to a variation in the distance from the position on the transfer belt 18 that the sensor 104 faces to the position between the transfer belt 18 and the transfer roller 7. Therefore, occurrence of positional displacement of images to be formed on a sheet can be suppressed.

7. Modifications

While the description has been made in detail with reference to the embodiments thereof, it would be apparent to those skilled in the art that many modifications and variations may be made therein without departing from the scope of the disclosure.

The image forming apparatus 1 according to the embodiment includes the drum unit 3. However, according to a modification of the embodiment, the image forming apparatus 1 may include a frame 106 as an example of a support member, in place of the drum unit 3.

Figure 12:
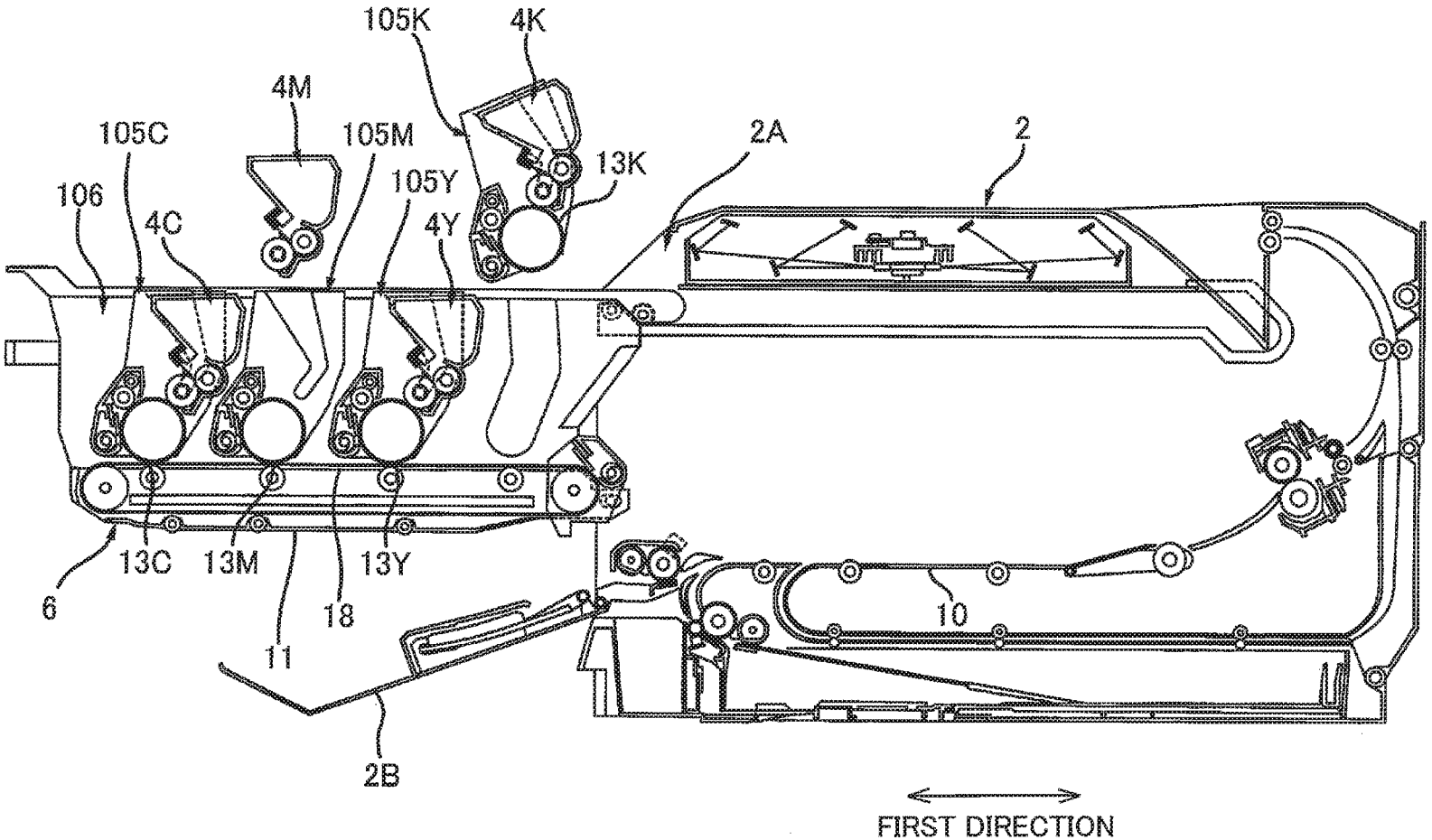
FIG. 12 is an explanatory diagram of an image forming apparatus according to a modification of the embodiment.

As illustrated in FIG. 12, the photosensitive drums 13K, 13Y, 13M, and 13C are detachably supported at the frame 106. That is, the frame 16 may detachably support a plurality of process cartridges 105K, 105Y, 105M, and 105C. The process cartridges 105K, 105Y, 105M, and 105C have the same structure as one another. Thus, the following descriptions will be given with reference to the process cartridge 105K, and description of the process cartridges 105Y, 105M, and 105C will be omitted. The process cartridge 105K may include a drum cartridge including the photosensitive drum 13K, and the developing cartridge 4K detachably attached to the drum cartridge.

According to the above described embodiment, the image forming apparatus 1 includes the plurality of levers 33A and the plurality of levers 33B. However, in place of the plurality of levers 33A and the plurality of levers 33B, a plurality of magnets may be used as long as the drum unit 3 and the belt unit 6 can be connected to each other.

According to the above-described embodiment, the drum unit 3 includes the cam 34A and the cam 34B. However, in place of the cam 34A and the cam 34B, the drum unit 3 may include a parallel link mechanism as long as the plurality of levers 33A and the plurality of levers 33B can be moved.

The drum unit 3 may be movable between an attached position at which the drum unit 3 is attached to the main body casing 2 and a detached position at which the drum unit 3 is completely detached from the main body casing 2. That is, the drum unit 3 may be movable between the accommodated position and the withdrawn position, and further from the withdrawn position to the detached position. In this case, the accommodated position and the withdrawn position of the drum unit 3 are an example of the attached position.

Similarly, the belt unit 6 may be movable between an attached position at which the belt unit 6 is attached to the main body casing 2 and a detached position at which the belt unit 6 is completely detached from the main body casing 2. That is, the belt unit 6 may be movable between the accommodated position and the withdrawn position, and further from the withdrawn position to the detached position. In this case, the accommodated position and withdrawn position of the belt unit 6 are an example of the attached position.

What is claimed is:

1. An image forming apparatus comprising:

a main body casing having an opening;

a photosensitive drum;

a support member configured to support the photosensitive drum, the support member being movable through the opening between a first accommodated position and a first withdrawn position, wherein, at the first accommodated position, the support member is accommodated in the main body casing, and wherein, at the first withdrawn position, the support member is withdrawn from the main body casing;

a belt unit movable through the opening between a second accommodated position and a second withdrawn position, wherein, at the second accommodated position, the belt unit is accommodated in the main body casing, and wherein, at the second withdrawn position, the belt unit is withdrawn from the main body casing, the belt unit comprising:

a first sheet guide; and a transfer belt configured to be in contact with the photosensitive drum in a state where the support member supporting the photosensitive drum is at the first accommodated position and where the belt unit is at the second accommodated position, the belt unit being positioned below the photosensitive drum in a state where the support member supporting the photosensitive drum is at the first accommodated position and where the belt unit is at the second accommodated position, and the belt unit being movable from the second accommodated position to the second withdrawn position together with the support member in a case where the support member moves from the first accommodated position to the first withdrawn position;

a transfer roller configured to be in contact with an outer surface of the transfer belt in a state where the belt unit is at the second accommodated position; and a second sheet guide positioned below the belt unit and facing the first sheet guide to define a sheet conveying path between the first sheet guide and the second sheet guide in a state where the belt unit is at the second accommodated position, and the second sheet guide being configured to convey a sheet along the sheet conveying path toward a position between the transfer belt and the transfer roller.

2. The image forming apparatus according to claim 1, further comprising a connector configured to connect the support member to the belt unit in a case where the support member moves from the first accommodated position to the first withdrawn position.

3. The image forming apparatus according to claim 2, wherein the connector comprises a lever provided at the support member, the lever being movable between an engagement position and a disengagement position, wherein, at the engagement position, the lever is in engagement with the belt unit, and wherein, at the disengagement position, the lever is out of engagement with the belt unit, and wherein the belt unit moves from the second accommodated position to the second withdrawn position together with the support member in a state where the lever is at the engagement position.

4. The image forming apparatus according to claim 3, wherein the support member comprises a first handle configured to move the support member from the first accommodated position to the first withdrawn position, and wherein the first handle comprises a first grip configured to move the lever from the engagement position to the disengagement position.

5. The image forming apparatus according to claim 4, wherein the first handle further comprises a second grip facing the first grip, wherein the first grip is movable relative to the second grip between a first position spaced apart from the second grip and a second position closer to the second grip than the first position is to the second grip, and wherein the lever moves from the engagement position to the disengagement position in a case where the first grip moves from the first position to the second position.

6. The image forming apparatus according to claim 5, wherein the support member comprises a link moving in accordance with the movement of the first grip from the first position to the second position, and wherein the lever moves from the engagement position to the disengagement position in accordance with the movement of the link.

7. The image forming apparatus according to claim 6, wherein a moving direction of the link is different from a moving direction of the lever.

8. The image forming apparatus according to claim 6, wherein the link comprises a cam moving together with the first grip in accordance with the movement of the first grip from the first position to the second position, and wherein the cam has a sloped cam surface capable of contacting the lever.

9. The image forming apparatus according to claim 3, wherein the support member comprises a spring urging the lever from the disengagement position toward the engagement position.

10. The image forming apparatus according to claim 3, wherein the photosensitive drum includes a first photosensitive drum, and a second photosensitive drum arrayed with the first photosensitive drum in a first direction, wherein the support member is configured to support the first photosensitive drum and the second photosensitive drum, wherein the lever is a first lever, and wherein the support member further comprises:

a second lever positioned away from the first lever in the first direction, the second lever being movable between an engagement position and a disengagement position, wherein, at the engagement position, the second lever is in engagement with the belt unit, and wherein, at the disengagement position, the second lever is out of engagement with the belt unit; and a third lever positioned opposite to the first lever and the second lever with respect to the belt unit in an axial direction of the photosensitive drum, the third lever being movable between an engagement position and a disengagement position, wherein, at the engagement position, the third lever is in engagement with the belt unit, and wherein, at the disengagement position the third lever is out of engagement with the belt unit.

11. The image forming apparatus according to claim 3, wherein the support member comprises:

a first side frame; and a second side frame positioned opposite to the first side frame with respect to the photosensitive drum in an axial direction of the photosensitive drum, wherein the first side frame has a first surface facing the second side frame and a second surface opposite to the first surface, and wherein the lever is positioned at the second surface.

12. The image forming apparatus according to claim 11, further comprising a waste toner box, wherein the support member further comprises:

a cleaning blade configured to remove toner from the photosensitive drum; and a toner conveying tube configured to convey the toner removed by the cleaning blade to the waste toner box, and wherein the toner conveying tube is provided at the first surface of the first side frame.

13. The image forming apparatus according to claim 1, wherein the support member further comprises a first handle configured to move the support member from the first accommodated position to the first withdrawn position, wherein the belt unit further comprises a second handle configured to move the belt unit from the second accommodated position to the second withdrawn position, and wherein the belt unit is movable together with the support member by the second handle.

14. The image forming apparatus according to claim 1, further comprising a waste toner box provided at the main body casing, wherein the belt unit further comprises:

a drive roller configured to drive the transfer belt;

a belt toner conveying tube;

a main frame supporting the drive roller and the belt toner conveying tube;

a driven roller configured to drive the transfer belt in cooperation with the drive roller;

a belt cleaning blade in contact with the transfer belt and configured to remove toner from the transfer belt; and a sub-frame supporting the driven roller and the belt cleaning blade, the sub-frame being movable relative to the main frame, wherein the belt toner conveying tube is configured to receive the toner removed by the belt cleaning blade, wherein the support member further comprises:

a cleaning blade configured to remove toner from the photosensitive drum; and a toner conveying tube configured to convey the toner removed by the cleaning blade toward the belt toner conveying tube, the toner conveying tube having a first toner discharge opening, and wherein the belt toner conveying tube has a toner receiving opening and a second toner discharge opening, the toner receiving opening being in communication with the first toner discharge opening of the toner conveying tube in a state where the support member is at the first accommodated position and where the belt unit is at the second accommodated position, the second toner discharge opening being in communication with the waste toner box in a state where the belt unit is at the second accommodated position.

15. The image forming apparatus according to claim 14, wherein the support member further comprises a shutter movable between an open position opening the first toner discharge opening and a closed position closing the first toner discharge opening, and wherein the belt unit has a contact surface configured to be in contact with the shutter to move the shutter from the closed position to the open position, in a case where the support member moves from the first withdrawn position to the first accommodated position in a state where the belt unit is at the second accommodated position.

16. The image forming apparatus according to claim 15, wherein the contact surface maintains contact with the shutter to position the shutter at the open position in a case where the belt unit moves together with the support member from the second accommodated position to the second withdrawn position.

17. The image forming apparatus according to claim 1, further comprising a waste toner box, wherein the belt unit further comprises:

a drive roller configured to drive the transfer belt;

a main frame supporting the drive roller;

a driven roller positioned spaced apart from the drive roller in a first direction, the driven roller being configured to drive the transfer belt in cooperation with the drive roller;

a belt cleaning blade in contact with the transfer belt and configured to remove toner from the transfer belt;

an auger screw configured to convey the toner removed by the belt cleaning blade toward the waste toner box; and a sub-frame supporting the driven roller, the belt cleaning blade, and the auger screw, the sub-frame being movable relative to the main frame in the first direction.

18. The image forming apparatus according to claim 17, wherein the transfer roller is positioned below the belt unit, the transfer roller being urged toward the transfer belt in a vertical direction, the transfer roller being movable together with the sub-frame in the first direction.

19. The image forming apparatus according to claim 1, wherein the first sheet guide includes a first sheet conveying roller configured to convey a sheet along the sheet conveying path toward the position between the transfer belt and the transfer roller.

20. The image forming apparatus according to claim 1, wherein the second sheet guide includes a second sheet conveying roller configured to convey a sheet along the sheet conveying path toward the position between the transfer belt and the transfer roller.

* * * * *